US009308921B2

(12) United States Patent
Worden et al.

(10) Patent No.: US 9,308,921 B2
(45) Date of Patent: Apr. 12, 2016

(54) TRACTIVE EFFORT SYSTEM AND METHOD

(75) Inventors: Bret Dwayne Worden, Erie, PA (US); Ajith Kuttannair Kumar, Erie, PA (US); Matthew John Malone, Lawrence Park, PA (US); Jennifer Lynn Coyne, Lawrence Park, PA (US); Nikhil Subhashchandra Tambe, Bangalore (IN); Milind Bharat Garule, Bangalore (IN); Anubhav Kumar, Bangalore (IN)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 13/816,036

(22) PCT Filed: Jul. 5, 2011

(86) PCT No.: PCT/US2011/042943

§ 371 (c)(1),
(2), (4) Date: Apr. 5, 2013

(87) PCT Pub. No.: WO2012/021225

PCT Pub. Date: Feb. 16, 2012

(65) Prior Publication Data

US 2013/0206862 A1 Aug. 15, 2013

Related U.S. Application Data

(60) Provisional application No. 61/371,886, filed on Aug. 9, 2010.

(51) Int. Cl.
*B61C 15/10* (2006.01)

(52) U.S. Cl.
CPC ..... *B61C 15/107* (2013.01)

(58) Field of Classification Search
CPC ..... B61C 15/10; B61C 15/102; B61C 15/107
USPC ..... 291/2, 3, 11.1, 11.2, 11.3, 41, 46, 47
See application file for complete search history.

(56) References Cited

U.S. PATENT DOCUMENTS 1,486,578 A 3/1924 Harney
1,951,553 A 3/1934 Martin (Continued)

FOREIGN PATENT DOCUMENTS

BE 540032 A 8/1955
CN 2170241 Y 6/1994

(Continued)

OTHER PUBLICATIONS

Search Report and Written Opinion from corresponding PCT Application No. PCT/US2012/068852 dated Jun. 3, 2013.

(Continued)

*Primary Examiner* — Zachary Kuhfuss
(74) *Attorney, Agent, or Firm* — GE Global Patent Operation

(57) ABSTRACT

A system is provided for use with, a wheeled vehicle. The system includes a media reservoir capable of holding a tractive material that includes particulates; a nozzle in fluid communication with the media reservoir; and a media valve in fluid communication with the media reservoir and the nozzle. The media valve is controllable between a first state in which the tractive material flows through the media valve and to the nozzle, and a second state in which the tractive material is prevented from flowing to the nozzle. In the first state, the nozzle receives the tractive material from the media reservoir and directs the tractive material to a contact surface such that the tractive material impacts the contact surface that is spaced from a wheel/surface interface. The system can modify the adhesion or the traction capability of the contact surface with regard to a subsequently contacting wheel.

17 Claims, 17 Drawing Sheets

(56) References Cited

U.S. PATENT DOCUMENTS

| | | | | |
|---|---|---|---|---|
| 1,993,145 | A * | 3/1935 | Kirk | 291/28 |
| 2,597,719 | A | 5/1952 | Foster | |
| 2,606,781 | A * | 8/1952 | Loftus | 291/41 |
| 2,654,622 | A | 10/1953 | Foster | |
| 3,020,071 | A * | 2/1962 | Makinson | 291/11.3 |
| 3,345,097 | A * | 10/1967 | Smith | 291/3 |
| 3,345,098 | A * | 10/1967 | Kilgore et al. | 291/3 |
| 4,108,077 | A | 8/1978 | Laing | |
| 4,230,045 | A * | 10/1980 | Fearon | 104/279 |
| 4,434,719 | A * | 3/1984 | Mekosh, Jr. | 105/168 |
| 4,747,627 | A | 5/1988 | Shigeura et al. | |
| 4,781,121 | A * | 11/1988 | Kumar et al. | 104/279 |
| 5,119,991 | A * | 6/1992 | Divers | 239/117 |
| 5,580,106 | A * | 12/1996 | Dulberg et al. | 291/3 |
| 6,148,732 | A | 11/2000 | Conway et al. | |
| 6,276,281 | B1 | 8/2001 | Mesalic et al. | |
| 6,629,709 | B1 * | 10/2003 | Tunley et al. | 291/2 |
| 6,797,918 | B1 | 9/2004 | Higgins | |
| 6,893,058 | B2 * | 5/2005 | Kumar et al. | 291/2 |
| 6,976,713 | B2 * | 12/2005 | Kish et al. | 291/24 |
| 7,152,888 | B2 * | 12/2006 | Kumar et al. | 291/3 |
| 7,290,807 | B2 * | 11/2007 | Kumar | 291/2 |
| 7,594,682 | B2 * | 9/2009 | Kumar et al. | 291/2 |
| 8,073,591 | B2 * | 12/2011 | Bartling | 701/36 |
| 8,500,177 | B2 * | 8/2013 | Bartling | 291/25 |
| 2003/0197386 | A1 | 10/2003 | Dalrymple | |
| 2004/0070265 | A1 * | 4/2004 | Sakai et al. | 303/1 |
| 2004/0160064 | A1 * | 8/2004 | Kish et al. | 291/3 |
| 2004/0262425 | A1 | 12/2004 | Sakai et al. | |
| 2005/0140144 | A1 * | 6/2005 | Kumar | 291/2 |
| 2006/0005739 | A1 | 1/2006 | Kumar | |
| 2008/0252082 | A1 * | 10/2008 | Bartling | 291/3 |
| 2009/0032350 | A1 | 2/2009 | Shapery | |
| 2010/0070117 | A1 | 3/2010 | Siffert | |
| 2010/0186619 | A1 | 7/2010 | Kumar | |
| 2011/0099413 | A1 | 4/2011 | Cooper et al. | |
| 2011/0308765 | A1 * | 12/2011 | Kumar et al. | 165/47 |
| 2012/0158223 | A1 * | 6/2012 | Liberatore et al. | 701/19 |
| 2014/0151460 | A1 * | 6/2014 | Noffsinger et al. | 239/69 |

FOREIGN PATENT DOCUMENTS

| | | | |
|---|---|---|---|
| CN | 201283865 | Y | 8/2009 |
| DE | 1195793 | B | 7/1965 |
| DE | 19640559 | A1 | 4/1998 |
| DE | 102005001404 | A1 | 7/2006 |
| DE | 102007044367 | A1 | 3/2009 |
| EP | 0499199 | A2 | 8/1992 |
| WO | 0071399 | A1 | 11/2000 |
| WO | 2006062056 | A1 | 6/2006 |

OTHER PUBLICATIONS

Unofficial English translation of Office Action issued in connection with corresponding CN Application No. 201180039129.8 on Sep. 3, 2014.

US Non-Final Rejection issued in connection with corresponding U.S. Appl. No. 13/300,147, filed Jun. 6, 2014.

Search Report and Written Opinion from PCT Application No. PCT/US20121059840 dated May 28, 2013.

* cited by examiner

TRACTIVE EFFORT SYSTEM AND METHOD

CROSS REFERENCE TO RELATED APPLICATIONS

This application is a National Stage of International Application No. PCT/US11/042943, filed on Jul. 5, 2011, which claims the benefit of U.S. Provisional Application Ser. No. 61/371,886 filed on Aug. 9, 2010, which are herein incorporated by reference in their entireties.

TECHNICAL FIELD

Embodiments of the invention relate to a tractive effort system for modifying the traction of a wheel contacting a surface, and associated methods.

DISCUSSION OF ART

It is sometimes desired in the rail industry to increase the tractive force of a locomotive to facilitate the transport of large and heavy cargo. Tractive force is the pulling or pushing force exerted by a vehicle, machine or body. As used in the rail industry, tractive effort (which is synonymous with tractive force) is the pulling or pushing capability of a locomotive, i.e., the pull force a locomotive is capable of generating. Tractive effort further may be classified as starting tractive effort, maximum tractive effort and continuous tractive effort. Starting tractive effort is the tractive force that can be generated at a standstill. Starting tractive effort is of great importance in railway engineering because it limits the maximum weight that a locomotive can set in motion from a dead stop. Maximum tractive effort is the maximum pulling force of the locomotive or vehicle and continuous tractive effort is the pulling force that can be generated by the locomotive or vehicle at any given speed. Additionally, tractive effort applies to stopping capability.

Tractive adhesion, or simply, adhesion, is the grip or friction between a wheel and the surface supporting the wheel. Adhesion is based in large part on friction, with maximum tangential force producible by a driving wheel before slipping given by:

$$F\text{max}=(\text{coefficient of friction})\cdot(\text{weight on wheel})\cdot(\text{gravity})$$

For a long, heavy train to accelerate from standstill at a desired acceleration rate, the locomotive may need to apply a large tractive force. As resistive forces increase with velocity, at some given rate of movement the tractive effort will equal the resistive forces and the locomotive will not be able to accelerate further, which may limit a locomotive's top speed.

Further, if the tractive force exceeds the adhesion the wheels will slip on the rail. Increasing adhesion, then, can increase the amount of tractive force that can be applied by the locomotive. The level of adhesion, however, is ultimately limited by the capacity of the system hardware. Because adhesion may be at least partially dependent on the frictional conditions between the steel wheel of the locomotive and the steel rail, inclement weather, debris and operating conditions such as travel around corners can lower the adhesion available and exacerbate traction problems.

Even with optimal conditions, however, metal wheels on the metal track may have insufficient traction for a task at hand, especially when hauling heavy loads. In addition, the surfaces, i.e., the rail and the wheels, may be smooth and the actual contact patch between a rail and a wheel can be very small. Accordingly, poor traction can make it difficult for a locomotive to haul heavy cargos and particular difficulty may arise during a start or up a grade. Operation of the vehicle above the maximum tractive effort is problematic, and is sometime referred to as being adhesion limited.

Inadequate traction may cause wheel noise and rail wear. Moreover, slipping wheels cause wear to the track, the wheels, and to the entire train. In particular, as wheels slip, they may damage the track and be burnished and abraded by the track. The wheels can go out of round and/or develop flat spots. This damage to the wheel and rail may cause vibrations, damage transported goods, and wear on train suspension. Wear to the track also causes vibrations and wear. In connection with this, wear patterns on a rail surface can result in high frequency vibrations and audible noise.

Currently, sand may be applied to the interface of the drive wheels of the locomotive with the rail surface to increase traction. This method, however, provides only marginal extra traction, as some or all of the applied sand on the rail falls off after the passage of one wheel set. Of note is that the angle of the sander nozzle aims to direct sand directly to the wheel/rail interface to increase the amount of sand present and available to provide traction.

It may be desirable to have a system and method that differs from those currently available with properties and characteristics that differ from those properties of currently available systems and methods.

BRIEF DESCRIPTION

In one embodiment, a system is provided for use with a wheeled vehicle. The system includes a media reservoir capable of holding a tractive material that includes particulates; a nozzle in fluid communication with the media reservoir; and a media valve in fluid communication with the media reservoir and the nozzle. The media valve is controllable between a first state in which the tractive material flows through the media valve and to the nozzle, and a second state in which the tractive material is prevented from flowing to the nozzle. In the first state, the nozzle receives the tractive material from the media reservoir and directs the tractive material to a contact surface such that the tractive material impacts the contact surface that is spaced from a wheel/surface interface. The system can modify the adhesion or the traction capability of the contact surface with regard to a subsequently contacting wheel.

In one embodiment, a system is provided for use with a vehicle that has a plurality of wheels for traveling over a surface. The system includes a nozzle capable of receiving tractive material from a reservoir and directing the tractive material to a contact surface; a sensor configured to detect operational data; and a controller in electrical communication with the sensor for receiving the operational data therefrom. The controller can change an angle of incidence of the tractive material relative to the contact surface in dependence upon the operational data.

In one embodiment, a nozzle is provided for use with a tractive effort system for increasing adhesion. The tractive effort system is for a vehicle having a wheel contacting a surface. The nozzle includes a body defining a passageway therethrough and having an inlet accepting a tractive material and an outlet distributing the tractive material to a contact surface of the rail. The contact surface is a portion of the surface over which the wheel may travel. The nozzle also has an adjustment mechanism positioned within the passageway and movable between a first position and a second position for adjusting a flow area of the passageway.

In one embodiment, a method is provided. The method includes controlling a flow of pressurized air from an air reservoir to a nozzle that is oriented toward a contact surface. The contact surface is spaced from an interface of a wheel of a vehicle and a surface of which the contact surface and the interface are each portions thereof. The contact surface is impacted with tractive material that includes at least the pressurized air flow to remove debris from, or to modify the surface roughness of, the contact surface.

In one embodiment, a system is provided for use with a vehicle having a wheel that travels on a surface. The system includes at least one nozzle; and an air source that is in fluid communication with the nozzle. The nozzle receives the tractive material from the air source and directs a flow of the tractive material to a location on the surface that is a contact surface for the wheel. Further, the air source provides tractive material at a flow rate that is greater than about 2.83 cubic meters per minute as measured as the tractive material exits the nozzle.

In one embodiment, a system is provided for use with a vehicle having a plurality of wheels that each travel on one or more rail that is one of a plurality of rails. The system includes one or more reservoirs for selectively providing tractive material and a nozzle in fluid communication with at least one of the reservoirs. The nozzle can receive the tractive material and can direct a flow of the tractive material to a location on a contact surface of the rail. Further, the nozzle is disposed or is disposable above one of the rails, and is oriented facing towards the plurality of rails and is not oriented directly facing a proximate one of the plurality of wheels.

In one embodiment, a control system is provided for use with a vehicle. The control system includes a controller that can control a valve that is fluidly coupled to a nozzle. Tractive material may selectively flow through the nozzle to a contact surface that is proximate to but spaced from an interface of a wheel and a surface. The valve can open and close in response to signals from the controller. The controller can control the valve to provide tractive material to the contact surface or can prevent the flow of tractive material to the contact surface. The provision of tractive material may be in response to one or more trigger events, in which instance the controller will cause the valve to open and to provide tractive material to the nozzle. The trigger events include one or more of adhesion limited operation of the vehicle, loss or reduction of tractive effort during operation of the vehicle, and an initiation of a manual command calling for the provision of the tractive material. The prevention of the flow of tractive material may be in response to one or more prevention events. The prevention events may include the vehicle entering or being within in a designated prevention zone, an engagement of a safety lock out for the vehicle, a sensed measurement of available pressure in an airbrake system of the vehicle being below a threshold pressure level, a sensed measurement of a compressor on/off cycling pattern being within a determine set of cycling patterns, and a speed or a speed setting of the vehicle being in a determined speed range or determined speed setting range, respectively.

In one embodiment, a method is provided that includes adjusting an orientation of a nozzle of a tractive effort system based on a measured diameter of a wheel. The wheel is capable of traveling over a surface. The adjustment is such that the nozzle remains aligned with the surface in an orientation that is substantially the same or substantially unchanging regardless of changes in the wheel diameter, for example due to wheel wear.

In one embodiment, a kit is provided for use with a vehicle having a wheel that travels on a rail, where a portion of the rail is a contact surface that is spaced from a wheel/rail interface. The kit does include a nozzle and a mounting bracket. The nozzle is configured to be in fluid communication with an air source for providing tractive material comprising a flow of air, and is capable of receiving from the air source the flow of air having at least one of a pressure that is greater than 689500 Pascal as measured prior to the tractive material exiting the nozzle or a flow rate that is greater than 2.83 cubic meters per minute as measured as the tractive material exits the nozzle, and thereby to deliver the tractive material to the contact surface at a velocity that is greater than 45 meters per second (e.g., greater than 45.72 meters per second) as measured as the tractive material impacts the contact surface. The mounting bracket can adjustably mount the nozzle to the vehicle to be oriented relative to the rail inwardly facing towards the plurality of rails and to the contact surface. The kit optionally includes a media reservoir capable of holding a type of tractive material that includes particulates, and a valve that is controllable by a controller to selectively allow a flow of the particulates when the valve is in an open position.

In one embodiment, a system is provided that includes a rail network controller. The rail network controller is for use with a rail network that includes arrival/departure locations connected via railway tracks for use by a plurality of locomotives that travel on the railway tracks from one arrival/departure location to another arrival/departure location in the rail network. At least a portion of the plurality of locomotives includes a tractive effort management system that is operable to detect information regarding a traction or adhesion level and to provide that traction or adhesion level information to the rail network controller. The rail network controller can determine which of the arrival/departure locations has an associated reduced traction situation based at least in part on the traction or adhesion level information provided by the tractive effort management system(s) included on the at least a portion of the plurality of locomotives. The rail network controller responds to the determination of the reduced traction situation at the associated arrival/departure location by one or both of controlling a velocity of the locomotives through the rail network such that the starting or stopping distance, or starting or stopping time, of a locomotive at the reduced traction situation arrival/departure location is calculated differently by the rail network controller if the locomotive includes a tractive effort management system relative to a locomotive that does not have a tractive effort management system, or controlling a routing of one or more locomotives the plurality of the locomotives through the rail network based on both of the presence or absence of a tractive effort management system on each locomotive and on the determined reduced traction situation at one or more of the arrival/departure locations.

In one embodiment, a tractive effort management system is provided that is supported by a wheeled vehicle that has a plurality of operating modes. The tractive effort management system includes a controller that is operable to determine a location of the wheeled vehicle on a determined route having one or more straight portions and one or more curved portions, and of controlling the tractive effort management system in a first mode of operation on the straight portion, and in a second mode of operation on the curved portion.

In one embodiment, a vehicle is provided that includes a first powered axle and a second powered axle. The first powered axle is proximate an end of the vehicle, and the second powered axles is relatively distant from the vehicle end, and the second powered axle is coupled to a journal box that does not translate during a navigation of a curve by the vehicle. The vehicle also includes a tractive effort management system coupled to the journal box of the second powered axle. The tractive effort management system includes a nozzle and tractive material source coupled to the nozzle.

In one embodiment, a system is provided, for use with a locomotive having a wheel that travels on a rail. The system includes a nozzle oriented away from the wheel, and the nozzle can deliver a flow of abrasive particulate and/or air under pressure to a contact surface of the rail that is spaced from a wheel/rail interface.

In one embodiment, a system for is provided for use with a wheeled vehicle that travels on a surface. The system includes a nozzle and an air source. The air source is in fluid communication with the nozzle so that the nozzle receives tractive material comprising a flow of air from the air source and directs a flow of the tractive material to a location on the surface that is a contact surface, and the nozzle in combination with the air source provides the tractive material at a velocity of greater than 45 meters per second as measured as the tractive material impacts the contact surface. In one embodiment, the air source provides the tractive material to the nozzle at a pressure that is greater than 689500 Pascal (about 100 psi) as measured at or proximate to the nozzle just prior to the tractive material exiting the nozzle. Optionally, abrasive particulate material can be added to the air flow and become part of the flow of tractive material impacting the contact surface.

BRIEF DESCRIPTION OF DRAWINGS

Reference will be made in detail to exemplary embodiments of the invention, examples of which are illustrated in the accompanying drawings. Wherever possible, the same reference numerals used throughout the drawings refer to the same or like parts.

DETAILED DESCRIPTION

Figure 1:
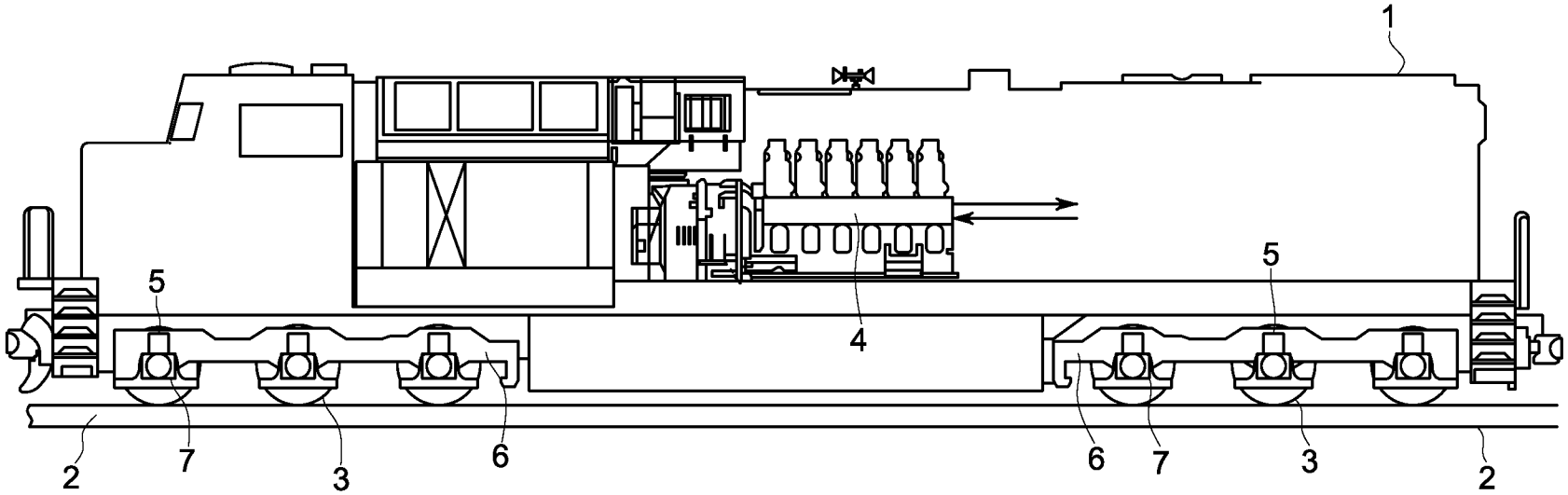
FIG. 1 is a schematic drawing of an exemplary rail vehicle.

Embodiments of the invention relate to a tractive effort system for modifying the traction of a wheel contacting a surface, and associated methods.

As used herein, "contact surface" means the area of contact on a surface that both is where a nozzle directs a stream of tractive material and where a portion of the surface will meet a wheel that is rolling over the surface; it is distinguished from the wheel/surface interface that, at any point in time, is where the wheel is actually contacting the surface. In exemplary instances, a surface can be a metal rail or pavement, and the wheel can be a metal wheel or a polymeric wheel. "Rail vehicle" can be a locomotive, switcher, shunter, and the like and includes both freight haulage and passenger locomotives, which themselves may be diesel electric or all electric, and that may run on either AC or DC electric power. "Debris" may mean leaves and vegetation, water, snow, ash, oil, grease, insect swarms, and other materials that can coat a rail surface and adversely affect performance. The terms "rail" and "track" may be used interchangeably throughout, and where practical include pathways and roads. Although discussed in more detail elsewhere herein, the term "tractive material" can include abrasive particulate matter as well as a flow of air, as such an air-only stream is defined. Context and explicit language may be used to identify and differentiate those applications that refer air plus abrasive or to air-only instances, but in the absence of a reference to abrasive particulate an air-only stream is intended, and with certain embodiments the option to selectively add particulate to the otherwise air-only stream. As used herein, the expression "fluidly coupled" or "fluid communication" refers to an arrangement of two or more features such that the features are connected in such a way as to permit the flow of fluid between the features and permits fluid transfer.

As used herein, "impact" means imparting a force greater than a force that would be imparted if the tractive material were applied to the contact surface under force of gravity only. For example, in an embodiment, the tractive material is ejected from the nozzle as a pressurized stream, the velocity of the tractive material exiting the nozzle is greater than the velocity of the tractive material if applied, to the contact surface by gravity only. As used herein, "roughness" is a measure of a profile roughness parameter of a surface. For purposes of illustration a rail implementation is provided in detail in which a locomotive with flanged steel wheels rides on a pair of steel tracks.

Embodiments of the invention relate to a tractive effort system for modifying the traction of a wheel contacting a rail or track. The tractive effort system includes a reservoir, in the form of a tank, capable of holding a tractive material and a nozzle coupled to the reservoir and in fluid communication therewith. The nozzle receives the tractive material from the reservoir and directs at least a portion of the tractive material to a contact surface of the rail prior to the contact surface being contacted by the wheel. The directed tractive material impacts the contact surface for modifying the traction of the wheel contacting the rail. That is, when the tractive material impacts the rail, it removes or clears debris from the rail allowing for more direct contact between the rail and the wheel. In addition, the tractive material may alter the contact surface of the rail to, for example, roughen smooth spots or to even out wear patterns that have formed in or on the rail. Moreover, the tractive material may both remove debris and alter the surface morphology of the rail upon impact.

In some embodiments, the tractive effort system may be configured for use in connection with a vehicle, such as a rail vehicle or locomotive. For example, FIG. 1 shows a schematic diagram of a vehicle, herein depicted as a rail vehicle 1, configured to run on a rail 2 via a plurality of wheels 3. As depicted, the rail vehicle 1 includes an engine 4, such as an internal combustion engine. A plurality of traction motors 5 are mounted on a truck frame 6, and are each connected to one of a plurality of wheels 3 to provide tractive power to propel and retard the motion of the rail vehicle 1. A journal box 7 may be coupled to truck frame 6 at one or more of the wheels 3. The traction motors 5 may receive electrical power from a generator to provide tractive power to the rail vehicle 1.

Figure 2:
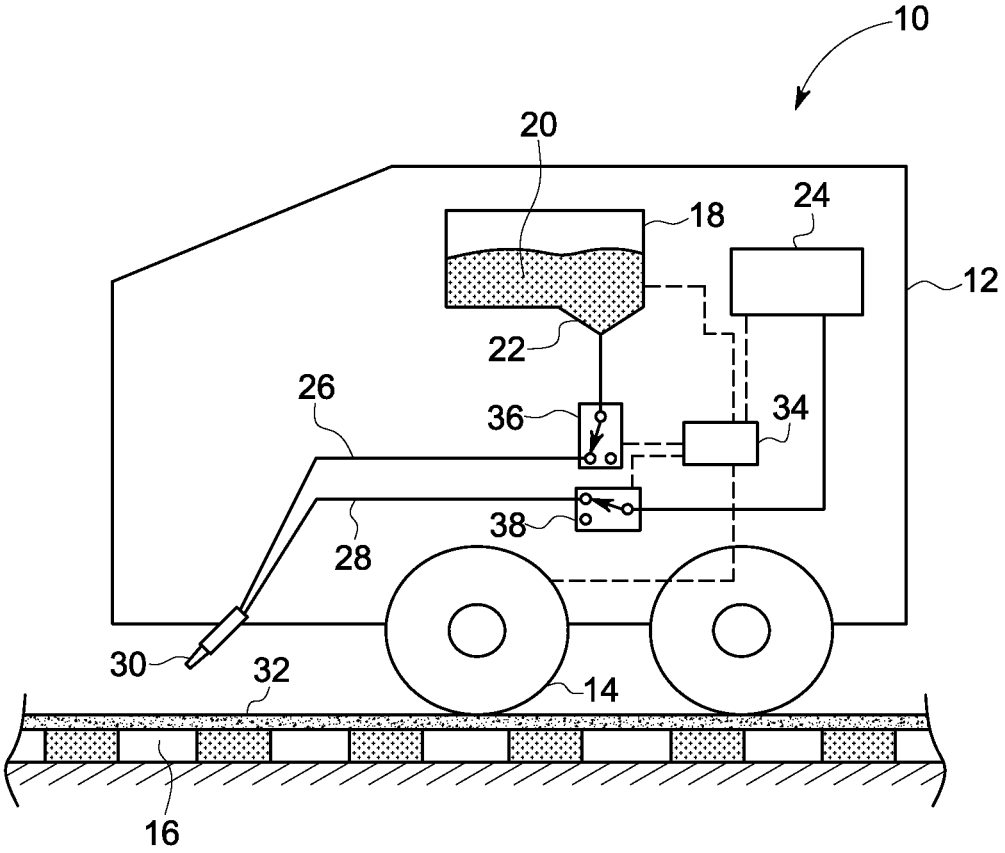
FIG. 2 is a schematic drawing of a tractive effort system according to an embodiment of the invention.

A schematic diagram illustrating a tractive effort system 10 including an embodiment of the invention is shown in FIG. 2. In the illustrated embodiment, the system is deployed on a rail vehicle 12 that has at least one wheel 14 for traveling over a rail 16. As shown therein, the tractive effort system includes an abrasive reservoir/tractive media reservoir 18, in the form of a tank, capable of holding a volume of tractive material 20 and having a funnel 22 from which the tractive material 20 may be dispensed. In an embodiment, the reservoir is unpressurized. The system also includes an air reservoir 24 containing a supply of pressurized air. The air reservoir 24 may be a main reservoir equalization tank that enables the function of numerous operational components of the vehicle, such as air brakes and the like. In another embodiment, the air reservoir 24 may be a dedicated air reservoir for the tractive effort system 10. An abrasive conduit 26 and an air supply conduit 28 carry the tractive material from the abrasive reservoir and pressurized air from the air reservoir, respectively, to a nozzle 30, at which the tractive material is entrained in the pressurized air stream to accelerate the tractive material onto a contact surface 32 of the rail. The tractive material impacts the contact surface at speed and removes any debris present and/or increases the surface roughness of the rail (i.e., the contact surface), as discussed in detail below.

As further shown therein, the system further includes a controller 34 that controls the supply of tractive material and/or the pressurized air from the air reservoir 24. In an embodiment, pressurized air alone may be discharged from the nozzle. In connection with the controller, the system may also include a media valve 36 and an air valve 38. The media valve 36 is in fluid communication with the output of the funnel 22 of the reservoir 18 and is controllable between a first state or position in which the tractive material may flow to the nozzle (as shown in FIG. 2), and a second state or position in which the tractive material cannot flow to the nozzle. The first and second states may be open and closed states, respectively.

The air valve 38 is in fluid communication with the air reservoir. In an embodiment, the air reservoir is a vessel that contains pressurized air (e.g., it may be the storage tank of an air compressor). In an embodiment, the air reservoir may be an existing component/system of the vehicle 12, such as a main reservoir equalization tank (MRE). As with the media valve 36, the air valve 38 is controllable between a first state or position in which pressurized air may flow to the nozzle (as shown in FIG. 2), and a second state or position in which the pressurized air cannot flow to the nozzle. The first and second states may be open and closed states, respectively. As shown in FIG. 2, the controller is electrically or otherwise operably coupled to the media valve 36 and the air valve 38 for controlling the media valve 36 and the air valve 38 between their respective first and second states.

For applying the tractive material to the contact surface, the controller controls the media valve and the air valve to their first (i.e., open) states. For applying air only, the controller controls the media valve to its second state (i.e., closed) and the air valve to its first state (e.g., open). For an "off" condition, the controller controls the media valve and the air valve to their second (i.e., closed) states.

Figure 3:
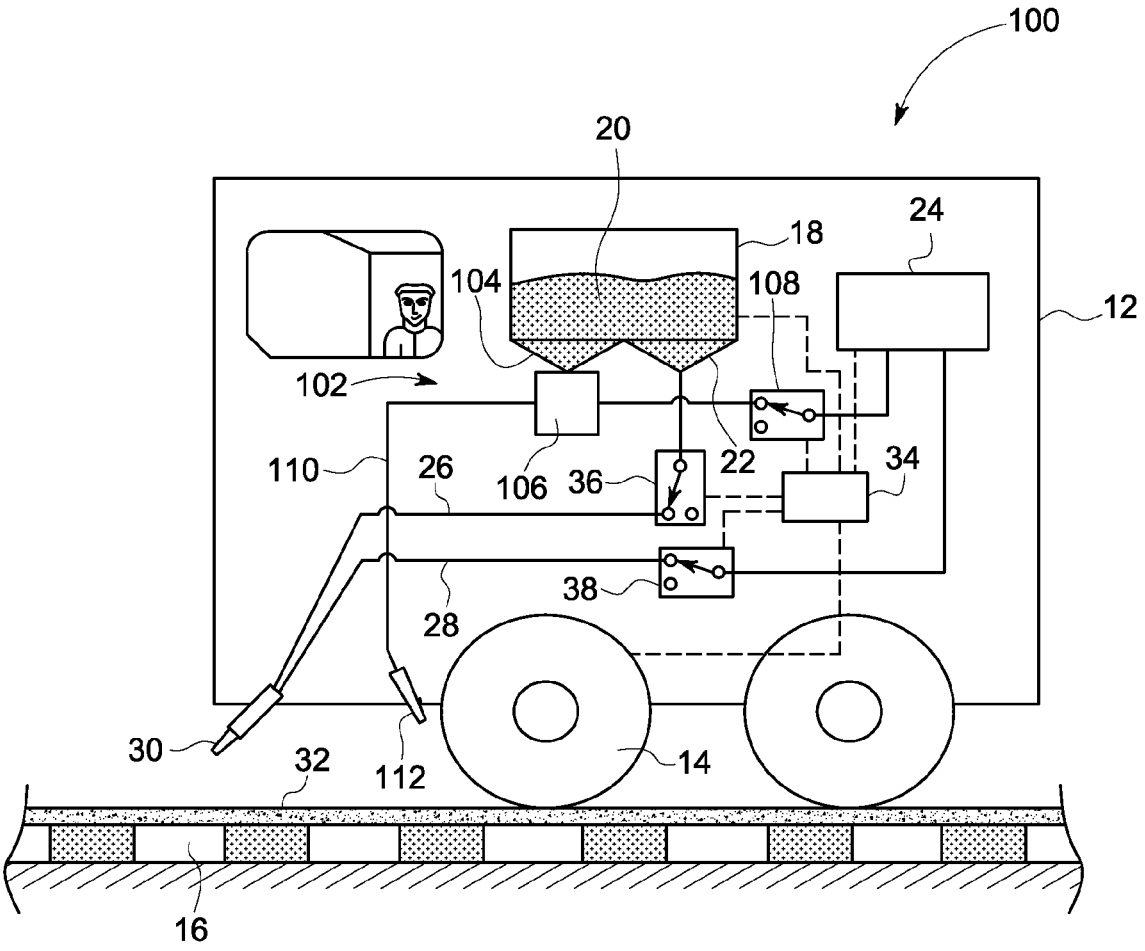
FIG. 3 is a schematic drawing of a tractive effort system in accordance with an embodiment of the invention.

FIG. 3 is a schematic diagram illustrating a tractive effort system in accordance with an embodiment of the invention. The system 100 shown in FIG. 3 is deployed on a locomotive (as a proxy for general vehicle types) that has a wheel for traveling over a rail. As shown therein, the tractive effort system includes a reservoir 18, in the form of a tank, capable of holding a volume of tractive material and having a first funnel 22 from which the tractive material is dispensed. The reservoir may be referred to as an abrasive reservoir to distinguish it from an air reservoir or some other reservoir. In one embodiment, the abrasive reservoir is unpressurized. The system also includes an air reservoir containing a supply of pressurized air. An abrasive conduit 26 and air supply conduit 28 carry the tractive material from the reservoir 18 and pressurized air from the air reservoir, respectively, to a nozzle, at which the tractive material 110 is entrained in the pressurized air stream to accelerate the tractive material onto the contact surface of the rail. As with the system of FIG. 2, the tractive material impacts the contact surface at speed and removes any debris present and/or increases the surface roughness of the rail (i.e., the contact surface).

As further shown therein, the system includes a controller that controls the amount, flow rate, pressure, type, and quantity of the supply of tractive material and/or the pressurized air from the air reservoir. In an embodiment, pressurized air alone may be discharged from the nozzle. In connection with the controller, the system 100 may also include a media valve 36 and an air valve 38. The media valve 36 is in fluid communication with the output of the funnel 22 of the reservoir 18 and is controllable between a first state or position in which the tractive material may flow to the nozzle (as shown in FIG. 3), and a second state or position in which the tractive material cannot flow to the nozzle. The first and second states may be open and closed states, respectively.

The air valve is in fluid communication with the air reservoir. In an embodiment, the air reservoir is a vessel that contains pressurized air (e.g., it may be the storage tank of an air compressor). In an embodiment, the air reservoir may be an existing component/system of the vehicle. As with the media valve, the air valve 38 is controllable between a first state or position in which pressurized air may flow to the nozzle (as shown in FIG. 3), and a second state or position in which the pressurized air cannot flow to the nozzle. The first and second states may be open and closed states, respectively. As shown in FIG. 3, the controller is electrically or otherwise operably coupled to the media valve and the air valve 38 for controlling the media valve and the air valve between their respective first and second states.

For applying the tractive material to the contact surface, the controller controls the media valve and the air valve to their first (i.e., open) states. For applying air only, the controller controls the media valve to its second state (i.e., closed) and the air valve to its first state (e.g., open). For an "off" condition, the controller controls the media valve and the air valve to their second (i.e., closed) states.

As further shown in FIG. 3, the tractive effort system also includes a sanding system 102. In an embodiment, the sanding system 102 utilizes the same reservoir 18 as a supply of tractive material, although separate tanks or reservoirs may be utilized without departing from the broader aspects of the invention. In the embodiment where a single reservoir 18 is employed, the reservoir includes a second funnel 104 from which the tractive material is dispensed. As shown in FIG. 3, the sanding system 102 includes a sand trap 106 in fluid communication with an output of the funnel 104 and in fluid communication with the pressurized air reservoir. A supply of pressurized air from the air reservoir to the sand trap 106 is regulated by a sander air valve 108. The sand trap 106 is in fluid communication, via a sanding conduit 110, with a sanding dispenser 112 (or "sander"). The sanding dispenser is oriented to provide a layer of sand onto the rail surface so that there is a layer of sand at the wheel/rail interface to enhance traction.

As with the media valve and air valve, the sander air valve 108 is controllable between a first state or position in which pressurized air may flow to the nozzle sand trap 106 (as shown in FIG. 3), and a second state or position in which the pressurized air cannot flow to the sand trap 106. The first and second states may be open and closed states, respectively. During one mode of operation, a layer of sand from the sander is directed to the wheel interface under conditions that allow for at least some of the sand to remain at the wheel interface. The dispensing of the layer of sand occurs after impacting the contact surface with the flow of tractive material. In this manner the sand is not blown away by the flow of tractive material having a flow rate or velocity that is otherwise sufficiently high to blow away any sand or particulate tractive material that may be used.

As shown in FIG. 3, the controller is electrically or otherwise operably coupled to the sander air valve 108 for controlling the valve 108 between its respective first and second states, a layer of sand from the media reservoir at the wheel interface through a sand dispenser under conditions that allow for at least some of the sand to remain at the wheel interface, and the dispensing of the layer of sand occurs after impacting the contact surface with the flow of tractive material, whereby the sand is not blown away by the flow of tractive material having a flow rate or velocity that is sufficiently high to blow away particulate tractive material.

Figure 4:
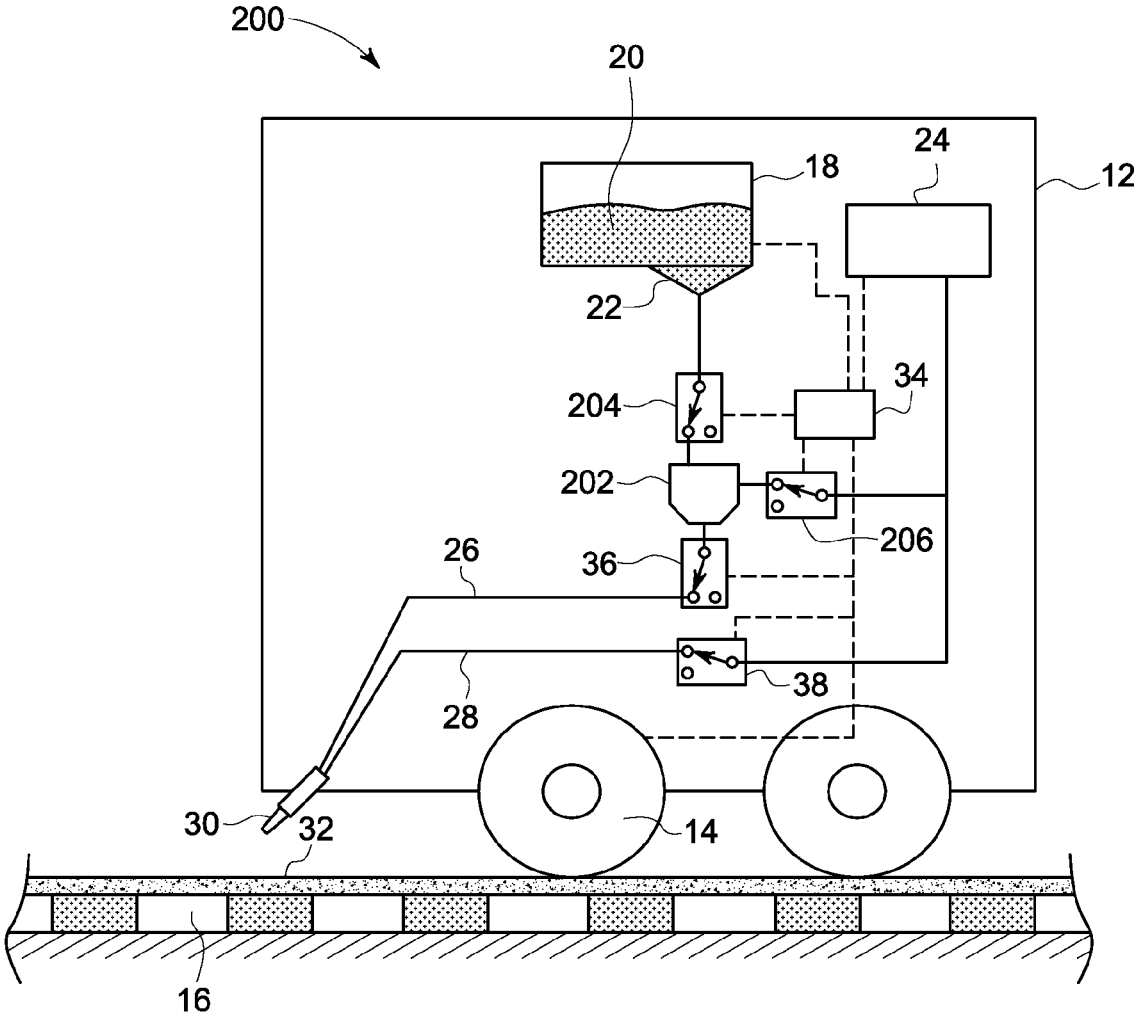
FIG. 4 is a schematic drawing of a tractive effort system in accordance with an embodiment of the invention.

With reference to FIG. 4, a schematic drawing of a tractive effort system 200 according to an embodiment of the invention is shown. The system 200 includes a pressurizable pressure vessel 202 that is fed tractive material from the unpressurized reservoir 18. For this purpose, the system 200 further comprises a batch valve 204 and a second air valve 206. The batch valve 204 is similar to the media valve, that is, it is controllable by the controller between first and second states thr permitting the passage of tractive material.

As shown in FIG. 4, an input of the batch valve 204 is fluidly coupled to the output of the first funnel 22 of the reservoir 18, and an output of the batch valve 204 is fluidly coupled to the input of the pressure vessel 202. The input of the media valve is fluidly coupled to the output of the pressure vessel 202, between the pressure vessel and the nozzle. The second air valve 206 is fluidly coupled between the air reservoir and a pressure input of the pressure vessel 202. The second air valve 206 is electrically coupled to and controllable by the controller 24 between first and second states (i.e., open and closed states, respectively), wherein in the first state pressurized air is supplied to the pressure vessel 202 and in the second state no pressurized air is supplied to the pressure vessel 202.

In operation, for applying air only to the contact surface of the rail, the controller controls the media valve to its second state (i.e., closed) and the first air valve to its first state (i.e., open). For filing the pressure vessel 202 with tractive material, the controller controls the media valve to its second state (i.e., closed), the second air valve 206 to its second state (i.e., closed), and the batch valve 204 to its first state (i.e., open). The batch valve 204 may be controlled to allow a sufficient volume of tractive material to fill the pressure vessel 202, based on time or volumetric flow or fill level sensors, or the batch valve 204 may be configured to be controllable to the second state (i.e., closed) despite the presence of tractive material within the batch valve 204.

For applying the tractive material to the contact surface, the controller controls the batch valve 204 to its second state (i.e., closed), the air valve to its second state (i.e., closed), and the media valve and the second air valve 206 to their respective first states (i.e., open). With the batch valve 204 and first air valve closed and the media valve and second air valve 206 open, the tractive material in the pressure vessel flows through the line and out of the nozzle. The tractive material impacts the contact surface at speed and removes an debris present and/or increases the surface roughness of the rail (i.e., the contact surface), as discussed hereinafter.

Figure 5:
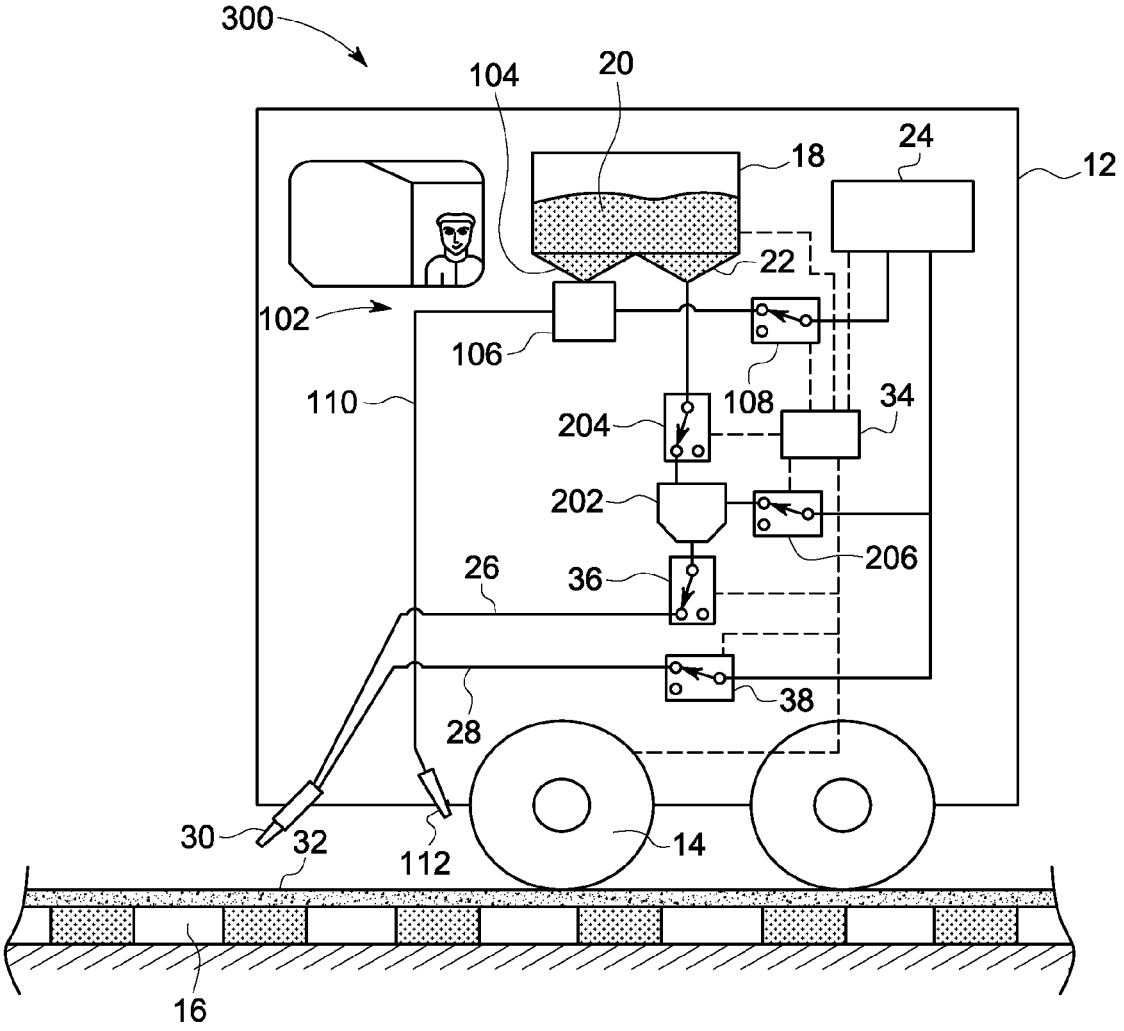
FIG. 5 is a schematic drawing of a tractive effort system in accordance with an embodiment of the invention.

Turning now to FIG. 5, a tractive effort system 300 according to an embodiment of the invention is shown. As depicted, the system 300 includes a sanding system 102, as disclosed above in connection with the system 100 shown in FIG. 2. As shown in FIG. 5, the system 300 includes a pressurizable pressure vessel 202 that is fed tractive material from the unpressurized media reservoir. The system 200 further includes a batch valve 204 and a second air valve 206. As shown therein, an input of the batch valve 204 is fluidly coupled to the output of the first funnel 22 of the reservoir 18, and an output of the batch valve 204 is fluidly coupled to the input of the pressure vessel 202. The input of the media valve is fluidly coupled to the output of the pressure vessel 202, between the pressure vessel and the nozzle. The second air valve 206 is fluidly coupled between the air reservoir and a pressure input of the pressure vessel 202. The second air valve 206 is electrically coupled to and controllable by the controller between first and second states open and closed states, respectively), wherein in the first state pressurized air is supplied to the pressure vessel 202 and in the second state no pressurized air is supplied, to the pressure vessel 202.

In operation of a system that can provide traction material with particulate, for applying air only to the contact surface of the rail, the controller controls a valve for particulate flow (e.g., media valve) to its second state (i.e., closed) and the first air valve to its first state (i.e., open). For filing the pressure vessel 202 with tractive material, the controller controls the media valve to its second state (i.e., closed), the second air valve 206 to its second state (i.e., closed), and the batch valve 204 to its first state (i.e., open). The batch valve 204 may be controlled to allow a sufficient volume of tractive material to fill the pressure vessel 202, based on time or volumetric flow or fill level sensors, or the batch valve 204 may be configured to be controllable to the second state (i.e., closed) despite the presence of tractive material within the batch valve 204.

For applying the tractive material to the contact surface, the controller controls the batch valve 204 to its second state (i.e., closed), the air valve to its second state (i.e., closed), and the media valve and the second air valve 206 to their respective first states (i.e., open). With the batch valve 204 and first air valve closed and the media valve and second air valve 206 open, the tractive material in the pressure vessel flows through line 26, out of the nozzle. The tractive material impacts the contact surface at speed and removes any debris present and/or increases the surface roughness of the rail (i.e., the contact surface), as discussed hereinafter.

As noted above, the system 300 further includes a sanding system 102. As discussed above in connection with FIG. 3, the sanding system 102 utilizes the same reservoir 18 as a supply of tractive material, although separate tanks or reservoirs may be utilized without departing from the broader aspects of the invention. In the embodiment where a single reservoir 18 is employed, the reservoir 18 includes a second funnel 104 from which the tractive material is dispensed. As shown in FIG. 3, the sanding system 102 includes a sand trap 106 in fluid communication with an output of the funnel 104 and in fluid communication with the pressurized air reservoir. A supply of pressurized air from the air reservoir to the sand trap 106 is regulated by a sander air valve 108. The sand trap 106 is in fluid communication, via a sanding conduit 110, with a sanding dispenser 112. The sanding dispenser 112 is oriented, to provide a layer of tractive material onto the rail surface just ahead of the wheel such that the wheel and rail receive a layer of tractive material therebetween, to enhance traction.

Figure 6:
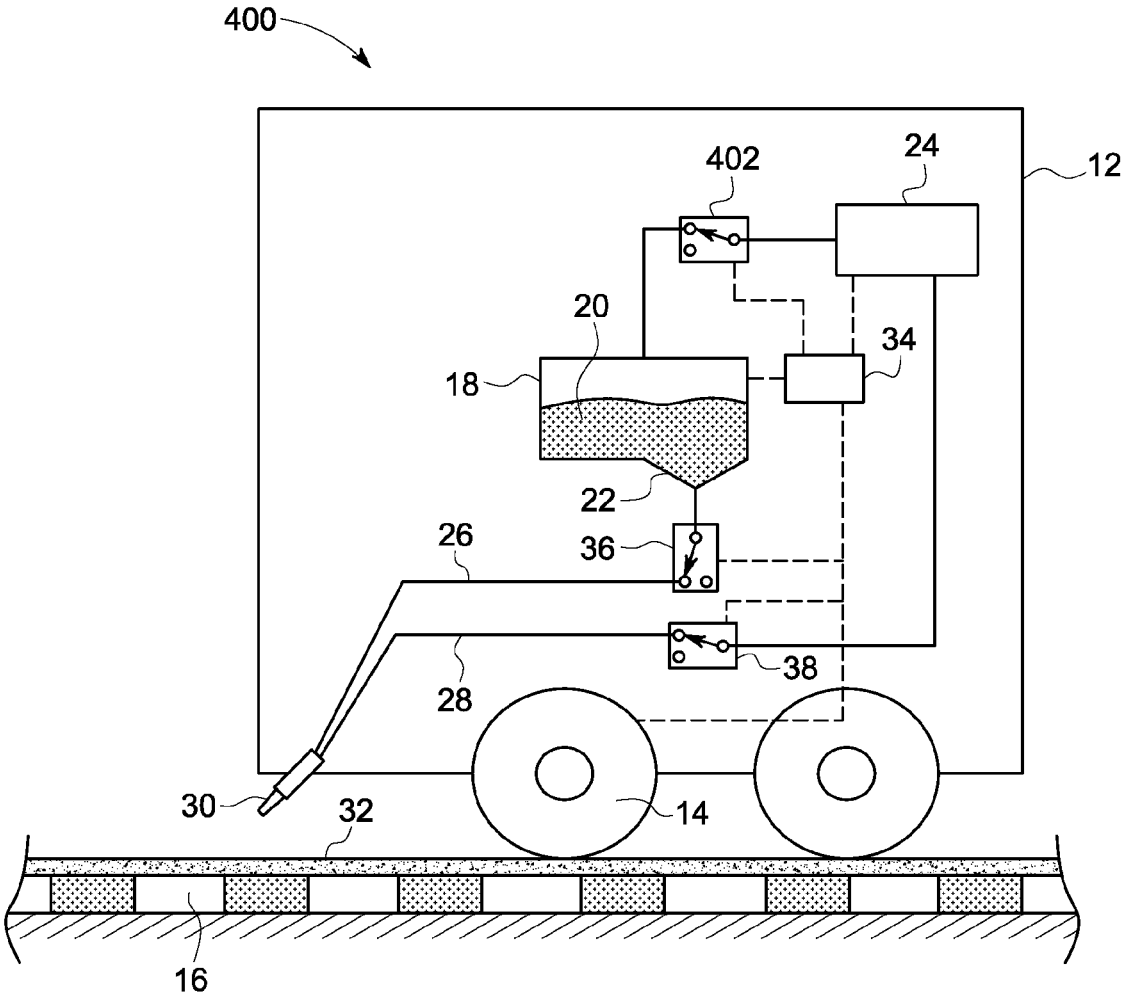
FIG. 6 is a schematic drawing of a tractive effort system in accordance with an embodiment of the invention.

With reference to FIG. 6, a schematic drawing of a tractive effort system 400 according to another embodiment of the invention is shown. As depicted, the system 400 includes an abrasive reservoir 18, in the form of a tank, capable of holding a volume of tractive material and having a funnel 22 from which the tractive material is dispensed. The system 10 also includes an air reservoir containing a supply of pressurized air. An abrasive conduit 26 and air supply conduit 28 carry the tractive material from the abrasive reservoir 18 and pressurized air from the air reservoir, respectively, to a nozzle, at which the tractive material is entrained in the pressurized air stream to accelerate the tractive material onto a contact surface of the rail.

In contrast to the system 10 of FIG. 2, the reservoir 18 of the system 400 is pressurized, as controlled through a pressurizing air valve 402, an input of which is in fluid communication with the air reservoir and an output of which is in fluid communication with tractive material reservoir 18.

The system 400 further includes a controller that controls the supply of tractive material and air 24. In an embodiment, pressurized air alone may be discharged from the nozzle. In connection with the controller, the system 10 may also include a media valve 36 and an air valve 38. The media valve is in fluid communication with the output of the funnel 22 of the reservoir 18 and is controllable between a first state or position in which the tractive material may flow to the nozzle (as shown in FIG. 6), and a second state or position in which the tractive material cannot flow to the nozzle. The first and second states may be open and closed states, respectively.

The air valve is in fluid communication with the air reservoir. In an embodiment, the air reservoir is a vessel that contains pressurized air (e.g., it may be the storage tank of an air compressor). In an embodiment, the air reservoir may be an existing component/system of the vehicle 12. As with the media valve and pressurizing air valve 502, the air valve is controllable between a first state or position in which pressurized air may flow to the nozzle, and a second state or position in which the pressurized air cannot flow to the nozzle. The first and second states may be open and closed states, respectively. As shown in FIG. 6, the controller is electrically or otherwise operably coupled to the media valve and the air valve for controlling the media valve and the air valve between their respective first and second states.

For applying the tractive material to the contact surface, the controller controls the pressurizing air valve 502, media valve and the air valve to their first (i.e., open) states such that tractive material is permitted to flow through line 26 to the nozzle. The tractive material is ejected from the nozzle and impacts the contact surface at speed and removes any debris present and/or increases the surface roughness of the rail (i.e., the contact surface), as discussed in detail below.

For applying air only, the controller controls the media valve to its second state (i.e., closed) and the air valve to its first state (e.g., open). For an "off" condition, the controller controls the media valve and the air valve to their second (i.e., closed) states.

As alluded to above, operation of the systems 10, 100, 200, 300, 400 in an abrasive deposition mode, in which tractive material is ejected from the nozzle and impacts the contact surface of the rail, increases the tractive effort of the vehicle or locomotive with which the system 10, 100, 200, 300 or 100 is employed. In such embodiments, the tractive material impacts the contact surface at speed and removes any debris present and/or increases the surface roughness of the rail (i.e., the contact surface).

In embodiments where the contact surface is modified by impacting tractive material, the modified roughness may be less than 0.1 micrometer (e.g., peaks with a height less than 0.1 micrometer), in a range of from about 0.1 micrometer to about 1 micrometer (e.g., peaks with a height from about 0.1 micrometer to about 1 micrometer), from about 1 micrometer to about 10 micrometers (e.g., peaks with a height from about 1 micrometer to about 10 micrometers), from about 10 micrometers to 1 millimeter (e.g., peaks with a height from about 10 micrometers to 1 millimeter), from about 1 millimeter to about 10 millimeters (e.g., peaks with a height from about 1 millimeter to about 10 millimeters), or greater than about 10 millimeters (e.g., peaks with a height greater than about 10 millimeters). In an embodiment, the modified morphology has peaks with a height that is greater than about 0.1 micrometer and less than 10 millimeters. According to one aspect, indicated peak heights are a maximum peak height.

In connection with the embodiments disclosed above, numerous operating parameters or characteristics of the systems 10, 100, 200, 300, 400 may be varied to produce a desired surface roughness. Such factors may include the type of tractive material utilized, the velocity of the tractive material exiting the nozzle, the quantity or flow rate of the tractive material, the type of rail, the speed of the vehicle 12, the distance of the nozzle from the contact surface, and other factors which may play a part in the resulting surface treatment. In various embodiments, the tractive material does not embed in the contact surface and/or the tractive material is substantially less hard than the rail track 16 and is incapable of being so embedded.

The degree that debris is removed from the track 16, and the degree to which the contact surface is modified, may affect the resultant level of observed tractive effort. In an embodiment, the tractive effort increases by an amount that is more than any one of water jetting the contact surface, scrubbing the contact surface, embedding particles into the contact surface, or laying loose sand particles over the contact surface. The increase in tractive effort may be 40,000 or more as a result of the application of the tractive material utilizing the systems 10, 100, 200, 300, 400 and method of the invention, e.g., tractive effort increases by a tractive effort value of at least 40,000 during application of the tractive material.

The tractive material may include particles that are harder than the track to be treated. Suitable types of harder particles include metal, ceramic, minerals, and alloys. A suitable hard metal can be tool grade steel, stainless steel, carbide steel, or a titanium alloy. Other suitable tractive materials may be formed from the bauxite group of minerals. Suitable bauxite material includes alumina ($Al_2O_3$) as a constituent, optionally with small amounts of titania ($Ti_2O_3$), iron oxide ($Fe_2O_3$), and silica ($SiO_2$) particles. In an embodiment, the alumina amount may constitute up to about 85 percent by weight or more of the mixture. Other suitable tractive materials can include crushed glass or glass beads. In other embodiments, the tractive material includes one or more particles formed from silica, alumina, or iron oxide. In an embodiment, other suitable tractive material can be an organic material. Suitable organic material can include particles formed from nutshells, such as walnut shells. Also of biologic origin, the tractive material can include particles formed from crustacean or seashells (such as skeletal remains of mollusks and similar sea creatures).

In one embodiment, the particles of the tractive material have a size in a range of from about 0.1 millimeters (mm) to about 2 mm. In other embodiments, the particle sizes of the tractive material may be in a range of from about 30 to about 100 standard mesh size, or from about 150 micrometers to about 600 micrometers. In an embodiment, the particles may have sharp edges or points. Particles with more than one sharp edge or point may be more likely to remove material or deform the rail track surface.

Additional suitable tractive materials include detergents, eutectics or salts, gels and cohesion modifiers, and dust reducers. All tractive materials can be used alone or in combination based on the application specific circumstances.

As noted above, with reference for example to FIG. 2, the systems 10, 100, 200, 300, 400 of the invention may be utilized onboard a vehicle 12 having a wheel 104 that is coupled to a powered axle of the vehicle 12. In an embodiment, the tractive effort system may be mounted on a vehicle that is part of a consist comprising a plurality of linked vehicles, where the wheel at issue (i.e., the wheel for which adhesion is to be increased) is mounted to a different vehicle in the consist. A situation might arise, where a consist is being used, where a first locomotive or other rail vehicle in the consist is not assigned a tractive effort system, but a second locomotive or later vehicle in the consist is equipped with a tractive effort system. In such cases, the slippage rate of the first locomotive can provide information to the controller about the travel conditions to tailor the tractive effort system's operations. In an embodiment, the tractive effort system may be mounted on the first locomotive to receive the entire tractive effort enhancement possible. It should be noted that in at least some circumstances the rail is a steel rail for use in transporting a rail vehicle. While FIGS. 2-6 shown the tractive effort system in connection with a locomotive, the system and method of the invention may be utilized on any rail vehicle, which is intended to encompass locomotives of all types, as well as switchers, shunters, slugs, and the like.

As disclosed above, the systems 10, 100, 200, 300, 400 may draw the tractive material (media) 20 from a media reservoir 18. In an embodiment, the reservoir 18 may be coupled to a heater, a vibrating device, a screen or filter, and/or a de-watering device.

In an embodiment, as shown in FIG. 6, for example, the reservoir tank 18 is pressurizable. In other embodiments, as shown in FIGS. 3 and 4, for example, tractive material is moved from a non-pressurized reservoir 18 to a pressure vessel 202, which is itself pressurizable. In either case, the pressure may be selected based on application specific parameters. Different embodiments may have correspondingly different air pressure requirements. In one embodiment, the air pressure may be greater than about 70 psi, but in other applications the operable pressure may be in a range of from about 75 psi to about 150 psi. During air-only operation (without the use of particulate in the fluid stream) in some instances the air pressure which might be sufficient for casting sand may not be sufficient to achieve a detectable increase in tractive effort. In one embodiment, the air-only mode of operation will use an air pressure that is greater than about 90 psi, or in a range of from about 90 psi to about 100 psi, from about 100 psi to about 110 psi, from about 110 psi to about 120 psi, from about 120 psi to about 130 psi, or from about 130 psi to about 140 psi.

In one embodiment on a locomotive, the air pressure is at the same pressure as the compressor supplied air used for the air brake reservoir at greater than about 100 psi or 689500 Pa (up to about ~135 psi). With equalized pressure the system, may therefore be operated without the addition of an air pressure regulator. This may reduce cost, extend system life and reliability, increase the ease of manufacture and maintenance, and reduce or eliminate one or more failure modes. To farther accommodate the relatively higher pressure applications, larger diameter piping may be employed than might be used with the relatively lower pressure (and possibly regulated) systems. The larger diameter piping may reduce the pressure drop experienced by the diameter downsized for a lower pressure and/or regulated system.

Air pressure is only one factor that may be considered in performance, other factors include air flow, air velocity, air temperature, ambient conditions, and operating parameters. With regard to air flow, the system may operate at flow rates of greater than 30 cubic feet per minute (CFM) for a pair of nozzles (each nozzle would have half of the value), or in a range of from about 30 CFM (about 0.85 cubic meters per minute) to about 75 CFM (about 2.12 cubic meters per minute), from about 75 CFM to about 100 CFM (about 2.83 cubic meters per minute), from about 100 CFM to about 110 CFM (about 3.11 cubic meters per minute), from about 110 CFM to about 120 CFM (about 3.40 cubic meters per minute), from about 120 CFM to about 130 CFM (about 3.68 cubic meters per minute), from about 130 CFM to about 140 CFM (about 196 cubic meters per minute), from about 140 CFM to about 150 CFM (about 4.25 cubic meters per minute), from about 150 CFM to about 160 CFM (about 4.53 cubic meters per minute), or greater than about 160 CFM for a nozzle pair. With regard to air velocity, the system may operate at an impact velocity of greater than 75 feet per second (FPS) (about 23 meters per second), or in a range of from about 75 FPS to about 100 FPS (about 30 meters per second), from about 100 FPS to about 200 FPS (about 61 meters per second), from about 200 FPS to about 300 FPS (about 91 meters per second), from about 300 FPS to about 400 FPS (about 122 meters per second), from about 400 FPS to about 450 FPS (about 137 meters per second), from about 450 FPS to about 500 FPS (about 152 meters per second), from about 500 FPS to about 550 FPS (about 168 meters per second), or greater than about 550 FPS.

In other embodiments, with regard to air flow, the system may operate at flow rates of greater than 0.85±0.05 cubic meters per minute for a pair of nozzles (each nozzle would have half of the value), or in a range of from 0.85±0.05 cubic meters per minute to 2.12±0.05 cubic meters per minute, from 2.12±0.05 cubic meters per minute to 2.83±0.05 cubic meters per minute, from about 2.83±0.05 cubic meters per minute to 3.11±0.05 cubic meters per minute, from 3.11±0.05 cubic meters per minute to 3.40±0.05 cubic meters per minute, from 3.40±0.05 cubic meters per minute to 3.68±0.05 cubic meters per minute, from 3.68±0.05 cubic meters per minute to 3.96±0.05 cubic meters per minute, from 3.96±0.05 cubic meters per minute to 4.25±0.05 cubic meters per minute, from 4.25±0.05 cubic meters per minute to 4.53±0.05 cubic meters per minute, or greater than 4.53±0.05 cubic meters per minute for a nozzle pair. With regard to air velocity, the system may operate at an impact velocity of greater than 23±1 meters per second, or in a range of from 23±1 meters per second to 30±1 meters per second, from 30±1 meters per second to 61±1 meters per second, from 61±1 meters per second to 91±1 meters per second, from 91±1 meters per second to 122±1 meters per second, from 122±1 meters per second to 137±1 meters per second, from 137±1 meters per second to 152 meters per second, from 152±1 meters per second to 168±1 meters per second, or greater than 68±1 meters per second.

An operational discussion is warranted at this point owing to the interaction of the air system of a locomotive with embodiments of the invention. One factor to consider is that a systemic loss of air pressure (or overall air volume) in an operating locomotive may "throw the safety brakes". Locomotive air brakes disengage when the pressure in the air lines is above a threshold pressure level, and to brake the locomotive the air pressure in the line is reduced (thereby engaging the brakes and slowing the train). Drawing a large volume of air from the system for any purpose may cause a concomitant pressure drop. So, drawing air for the purpose of affecting tractive effort may cause a pressure drop. Another factor to consider is the operation of the compressor that supplies the air to the system. The compressor life may be adversely affected by cycling it on and off to maintain pressure in a determined range. Naturally, the method of operation of a system that consumes large amounts of air could affect the compressor operation. With those and other considerations in mind, the system can include a controller that accounts for these factors. In one embodiment, the controller is advised of the air pressure in and/or environmental conditions of the locomotive system and responds by controlling the air usage of the inventive system. For example, if the locomotive air reservoir (MRE) pressure drops below a threshold value the controller will reduce or eliminate the air flow of the inventive system until the MRE pressure is restored to a defined pressure level, or if there is a pressure trend change over time (such as may be due to a change in altitude of the locomotive) the controller may respond by making a correspond change in the use of the inventive system. The changes may be, of course, binary in nature such as just a simple switching off of the system entirely. However, there may be some benefit at a reduced flow rate for which the controller can adjust down the flow rate and see some reduced level of traction improvement. The controller optionally also may send a notice that the mode of operation has been changed in this manner, or may log the event, or may do nothing beyond making the change. Such notice may be decided based on implementation requirements.

During use, high-pressure air from the air reservoir may be applied to the abrasive reservoir or to the pressure vessel 202 where the air is mixed with tractive material. The media/air mixture may move toward the delivery nozzle where the mixture is accelerated by the nozzle. While the embodiments disclosed herein shown a single nozzle for distributing tractive material or an tractive material/air mixture, multiple nozzles 30 may be employed without departing from the broader aspects of the invention. The nozzle may serve a dual purpose of accelerating the tractive material/mixture as well as directing the material/mixture to the rail contact surface. In an embodiment, in addition to air, pressurized water or a gel may be utilized. In embodiments where a gel is used, it may be capable of leaving sufficient entrained tractive material as to increase adhesion by its presence in addition to the adhesion increase caused by debris removal and/or surface modification.

Figure 7:
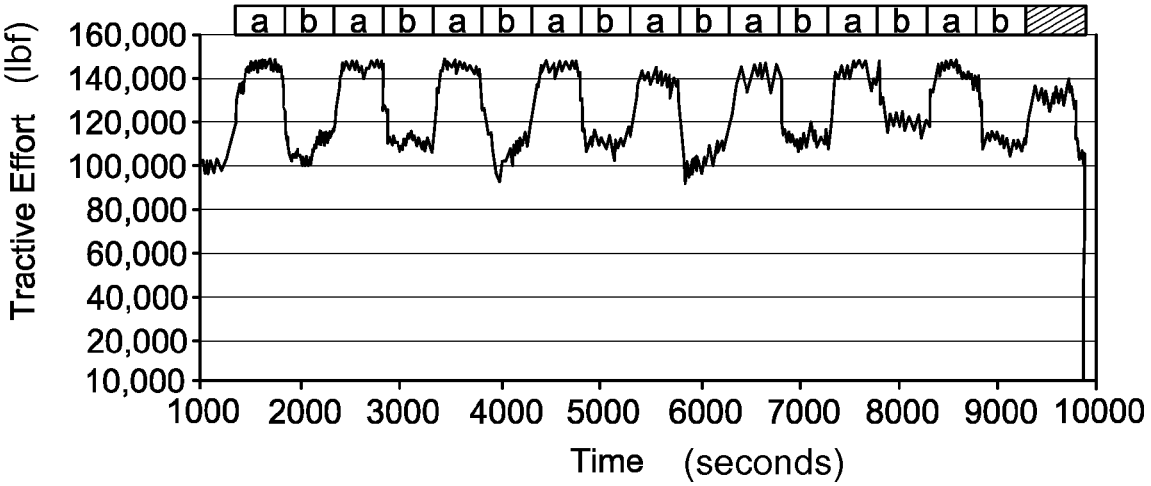
FIG. 7 is a graph illustrating tractive effort values achieved utilizing the tractive effort system of FIG. 3 under various operating conditions.

FIG. 7 is a graph illustrating tractive effort values achieved utilizing the tractive effort system of FIG. 3, with the sanding system 102 enabled, on a locomotive with five active axles on a wet rail over a period of time, at speeds of both 5 mph and 7 mph. The adhesion was measured, and the tractive effort system 200 was engaged and disengaged over time. In particular, intervals "a" represent the time periods when the tractive effort system is enabled, intervals "b" represent the time periods when the tractive effort system is disabled, and the black box indicates the time period when the tractive effort system may have only an air blast applied to the contact surface. As shown therein, results indicate that the wet rail adhesion increases in response to the impacting of the tractive material with the contact surface. As shown therein, adhesion is also increased when an air blast only is applied to the contact surface.

Here and elsewhere, the system is described in terms of one nozzle; however the inventive system can employ multiple nozzles that may operate independently or in a coordinated fashion under the direction of a controller. For lower pressure sources, the nozzle may be configured to create sufficient backpressure to accelerate the tractive material toward the contact surface during operation. In other embodiments, various attachments may be coupled to the nozzle. Suitable attachments may include, for example, vibrating devices, clog sensors, heaters, de-clogging devices, and the like. In one embodiment, a second nozzle may be present for supplying air, water, or a solution to the contact surface. The solution may be a solvent or may be a cleanser, such as a soap or detergent solution. Other solutions may include acidic solutions, metal passivation solutions (to preserve rail surfaces), and the like. Coupled to the nozzle may be a switch that stops the flow of tractive material while allowing a flow of air and/or water through the nozzle.

Figure 8:
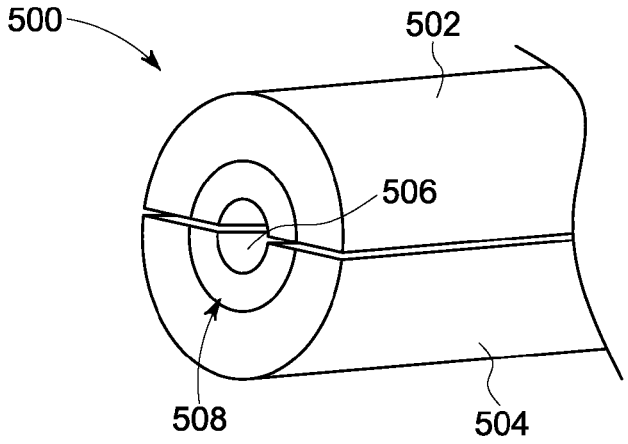
FIG. 8 is a detail perspective view of an anti-clogging nozzle, in accordance with an embodiment of the invention, for use with the tractive effort systems of FIGS. 2-6.
Figure 9:
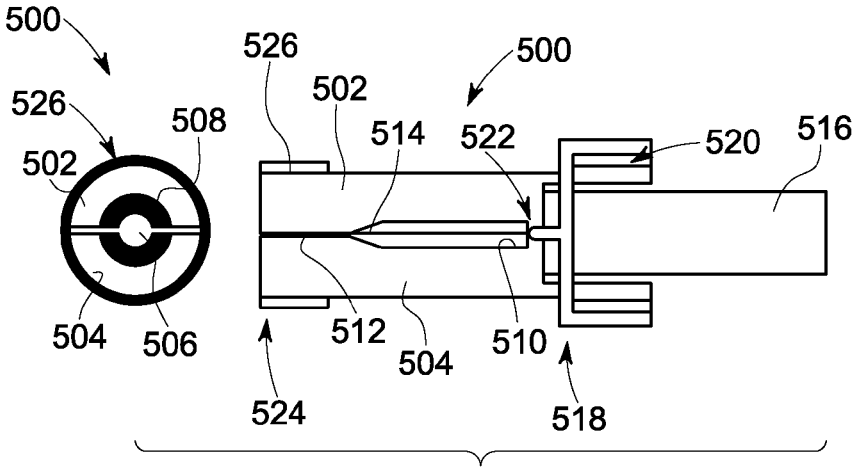
FIG. 9 is a detail view of the anti-clogging nozzle of FIG. 8 in an operating mode, in accordance with an embodiment of the invention.
Figure 10:
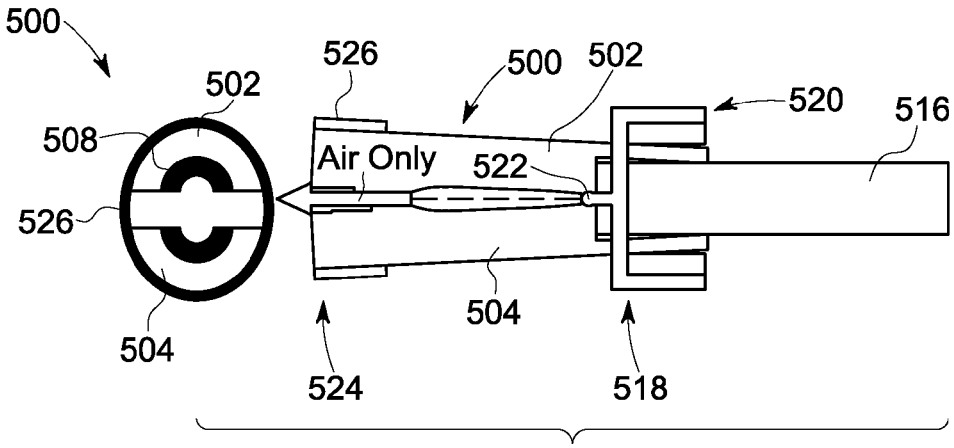
FIG. 10 is a detail view of the anti-clogging nozzle of FIG. 8 in a cleaning mode, in accordance with an embodiment of the invention.

FIGS. 8-10 shown various detail views of a nozzle 500 according to an embodiment of the invention, suitable for use as nozzle in connection with the systems 10, 100, 200, 300, 400 disclosed above. As shown in FIG. 8, the nozzle 500 includes a first half 502 and a second half 504 that cooperate with each other to define a throughbore 506 through which the tractive material may pass. As best shown in FIG. 8, a hardened inner liner 508 is disposed or otherwise formed within the bore 506. In an embodiment, the liner 508 may be formed from a wear-resistant material such as a ceramic or cermet.

Referring now to FIG. 9, diagrammatic side and end views of the nozzle 500 in an operating mode are shown. As depicted, the throughbore 506 nozzle 500 has an enlarged diameter rearward portion 510, a reduced diameter forward portion 512 and a constriction portion 514 forming a transition between the rearward portion 510 and the forward portion 512. The constriction 514 accelerates the tractive material under urging by the pressurized air toward the contact surface (FIG. 2). Pressurized air and/or tractive material are supplied by an air/media hose 516, which is in fluid communication with the throughbore 506.

During certain operating conditions, however, and especially in damp conditions, tractive material may clog the nozzle, thereby decreasing the effectiveness of the system. In particular, in damp conditions, sand or other tractive material may clog the nozzle orifice. This may be due to tractive material particles having a size greater than the orifice diameter. In the case where sand is used as the tractive material, the sand may agglomerate, clump or freeze into chunks. In some instances this may be due to moisture content in the sand. The presence of such agglomerates blocking the nozzle and causing pressure to build up upstream of the nozzle orifice. Accordingly, at least some embodiments of the invention are directed to a nozzle design that facilitates clog-free operation.

In one embodiment, as shown in FIG. 10, the nozzle 500 (suitable for use as a nozzle in the system disclosed in FIG. 2) contains anti-clogging features. As best shown in the diagrammatic side and end views of the nozzle 500 in FIG. 9, the two halves 502, 504 of the nozzle 500 are attached at a near 518 end by an air bellows collar 520 and pivot/hinge 522. The nozzle halves 502, 504 separate at a distal end 524 thereof as the pivot/hinge 522 rotates, and a blast of air only from the air reservoir dislodges any clogs in the throughbore 506 of the nozzle 500. During the operating mode illustrated in FIG. 8, an elastic member 526 such as an elastic band, elastic sleeve, or the like, deployed about the outer/distal end of the nozzle 500, keeps the distal end of the first half 502 and second half 504 of the nozzle 500 together. During cleaning, or to prevent clogging, however, the bellows collar 520 stretches the elastic member 526 and allows the halves 502, 504 at the distal end of the nozzle 500 to separate upon receiving a blast of pressurized air from the air reservoir, or when pressure builds up upstream of the nozzle orifice and reaches a threshold pressure that causes the halves 502, 504 to separate.

In one embodiment, an anti-clogging nozzle utilizes an adjustment mechanism deployed in a body/orifice of the nozzle to clean or unclog the nozzle. A suitable adjustment mechanism may be a spring and plunger mechanism deployed in an orifice of the nozzle. Examples of suitable anti-clogging mechanisms are shown in FIGS. 11-22. Referring first to FIGS. 11-14, an embodiment of an anti-clogging nozzle 600 is shown. As depicted, tractive material is supplied to the nozzle outlet by a passageway 602. The nozzle includes a plunger 604 (see FIG. 11) that moves up and down by means of a spring, as the internal/upstream pressure within the nozzle 600 is varied.

Figure 11:
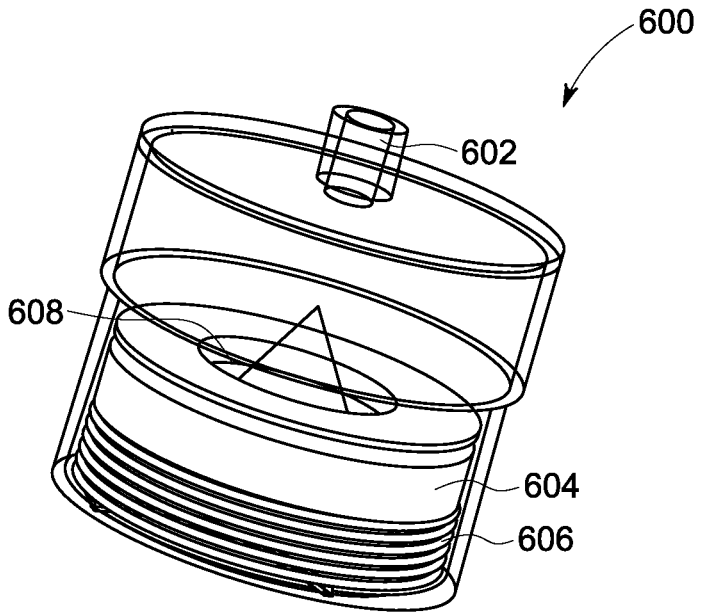
FIG. 11 is a perspective view of an anti-clogging nozzle, in accordance with an embodiment of the invention, in an unclogged state, for use with a tractive effort system.
Figure 12:
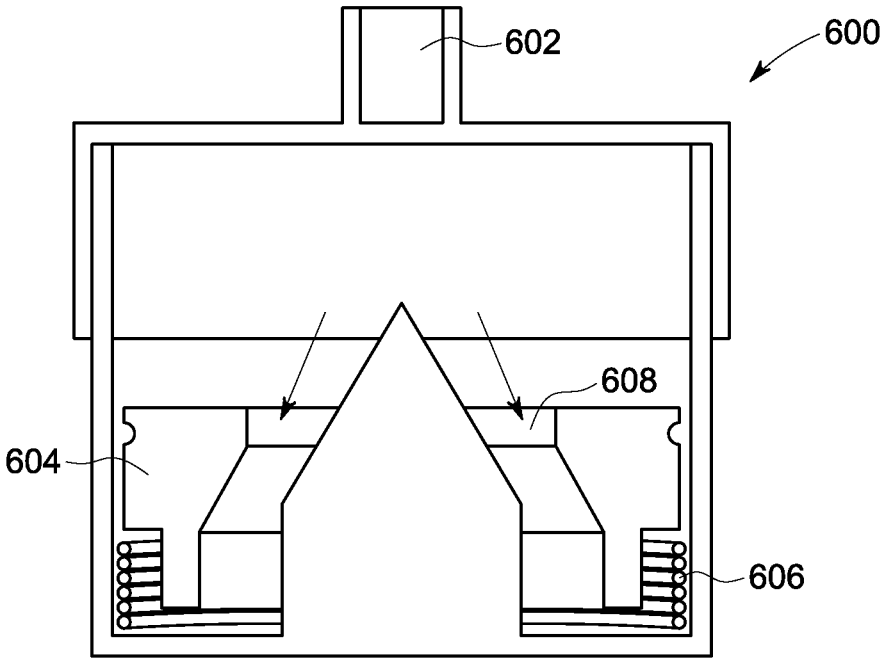
FIG. 12 is a side, cross-sectional view of the anti-clogging nozzle of FIG. 11.
Figure 13:
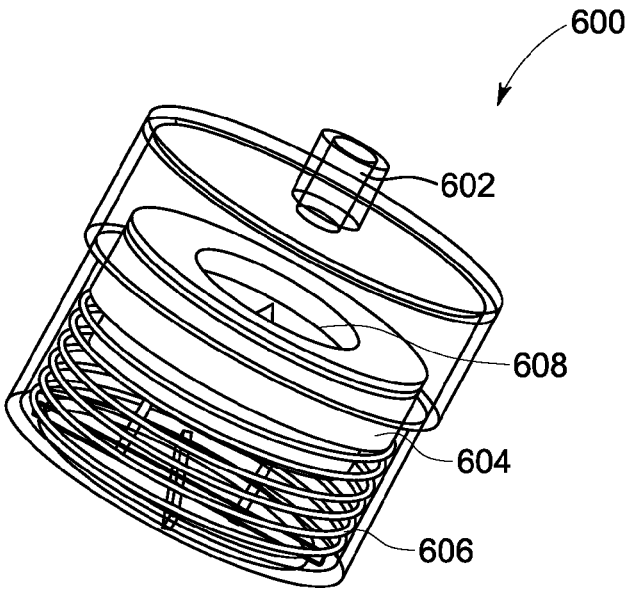
FIG. 13 is a perspective view of the anti-clogging nozzle of FIG. 11, in accordance with an embodiment of the present invention, in a clogged state.
Figure 14:
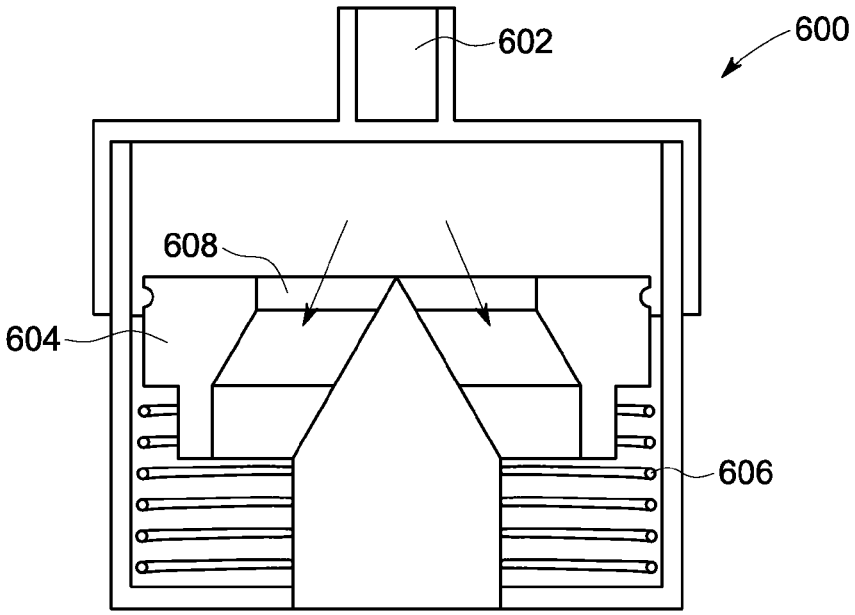
FIG. 14 is a side, cross-sectional view of the anti-clogging nozzle of FIG. 13.

A plunger and spring position under normal operating conditions, i.e., when the nozzle is not clogged are illustrated in FIGS. 11 and 12. As shown therein, tractive material moves past the plunger through the passage and is ejected from the nozzle 600. When abrasive particles agglomerate the pressure upstream increases, clogging the nozzle. The pressure has to be therefore reduced periodically, either manually or using a controller to allow the spring 606 to relax and reach a position as shown in the FIGS. 13 and 14. This will increase the area of the passage 608 and allow the bigger particles to be dropped or pushed out. After the larger abrasive particles have been dispensed out of the nozzle and the nozzle is clear, the spring biases the plunger to its default position, as shown in FIGS. 11 and 12, decreasing the pass through area of the passage.

Figure 15:
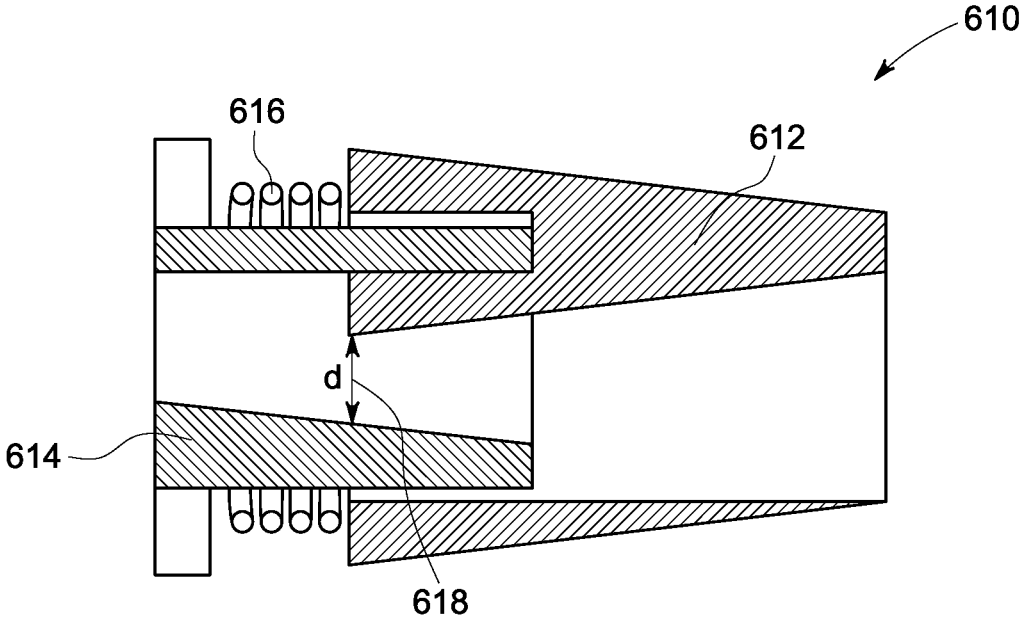
FIG. 15 is a side, cross-sectional view of an anti-clogging nozzle, in accordance with an embodiment of the invention, in an un-clogged state, for use with a tractive effort system.
Figure 16:
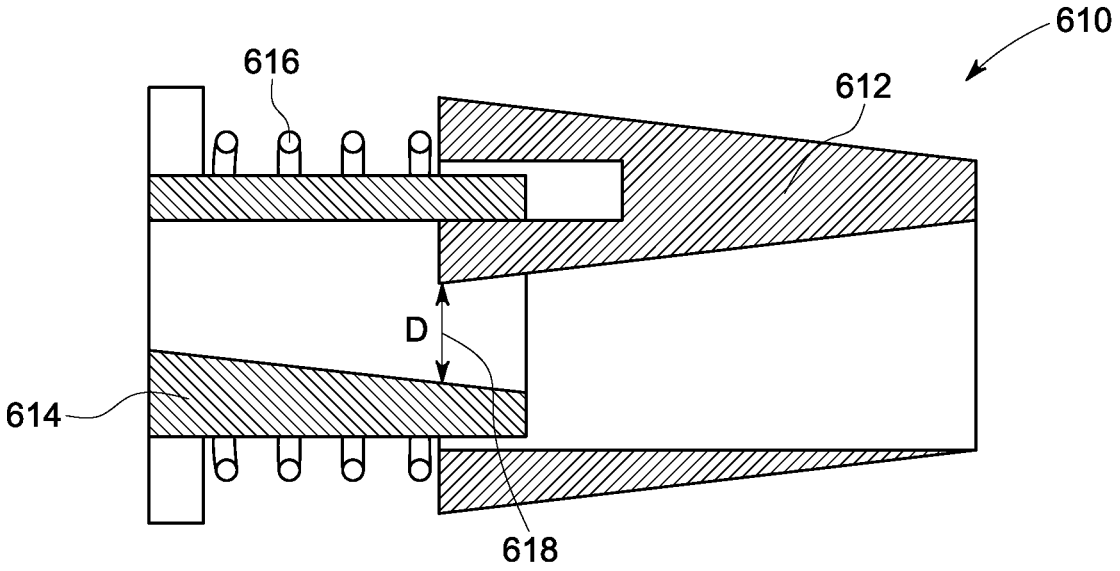
FIG. 16 is a side, cross-sectional view of the anti-clogging nozzle of FIG. 15, in accordance with an embodiment of the invention, in a clogged state.

An anti-clogging nozzle 610 according to an embodiment of the invention is illustrated in FIGS. 15 and 16. As shown therein, the nozzle 610 includes a body or first portion 612 defining a passageway there through and a second portion 614 slidably received by said first portion 612 and having a conical passageway formed therein. A biasing member, such as a spring 616, is received about a periphery of the second portion 614. In an unclogged position, the second portion 614 is nested within the first position such that the diameter, d, and thus an area of a passageway 618 between the first portion 612 and second portion 614 is at a minimum. In this position the spring may have a relatively different level of tension and/or compression. When abrasive particles agglomerate, however, flow of tractive material out of the nozzle 610 may be at least partially blocked and back pressure may build within the first portion 612. As pressure builds, the second portion 614 is forced away from the first portion 612, extending the spring 616 in tension, as shown in FIG. 16. As the second portion 616 is moved outward, the diameter of the passageway 618 increases to a diameter, D, as further shown in FIG. 16. This increases the area of the passage 618, thus allowing bigger abrasive particles to clear the nozzle 610. After the larger abrasive particles have been dispensed out of the nozzle 610 and the nozzle 610 is clear, the spring 616 biases the second portion 614 to its default, non-clogged position, as shown in FIG. 15, decreasing the area of the passage 618.

Figure 17:
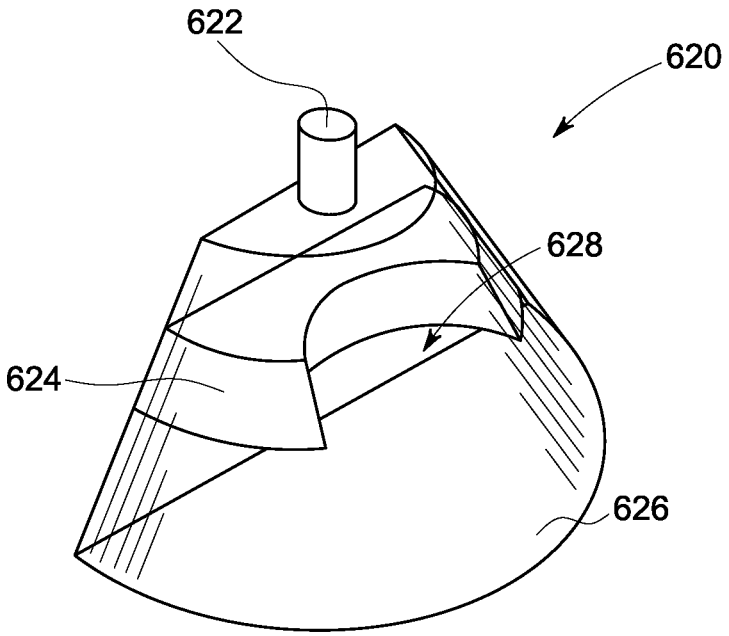
FIG. 17 is a perspective view of an anti-clogging nozzle, in accordance with an embodiment of the invention, in an un-clogged state, for use with a tractive effort system.
Figure 18:
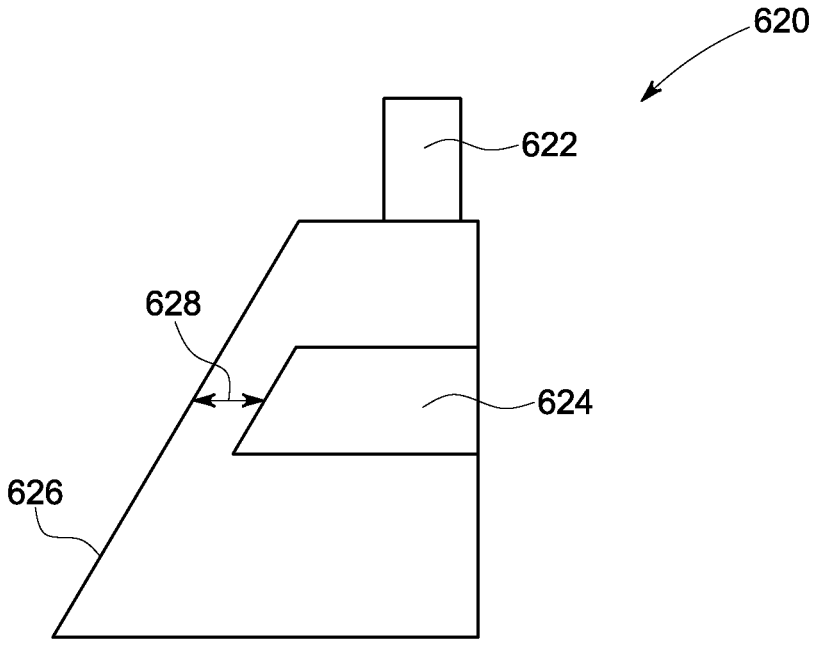
FIG. 18 is a partial, side cross-sectional view of the anti-clogging nozzle of FIG. 17.

FIGS. 17-20 illustrate an anti-clogging nozzle 620 according to another embodiment of the invention. As shown therein, tractive material is supplied to the nozzle outlet by a passageway 622. The nozzle 620 includes a plunger 624 that moves up and down within the nozzle orifice 626 as the internal/upstream pressure within the nozzle 620 is varied. FIGS. 17 and 18 illustrate plunger 624 position under normal operating conditions, i.e., when the nozzle 620 is not clogged. As shown therein, tractive material moves past the plunger 624 between the plunger and a wall of the nozzle orifice 626 in which the plunger 624 is disposed. As shown in FIG. 18, the passageway 628 for passage of tractive material is relatively small when the nozzle 620 is in an unclogged state. When abrasive particles agglomerate, however, as discussed above, flow of tractive material out of the nozzle 620 is prevented and pressure builds upstream of the plunger 624. As pressure builds, the plunger 624 is forced downwards, to the position shown in FIGS. 19 and 20. As the plunger 624 is moved downwards, the space between the plunger and the wall of the orifice, i.e., the passageway 628, is increased, thus allowing bigger abrasive particles to clear the orifice and the nozzle 620. After the larger abrasive particles have been dispensed out of the nozzle 620 and the nozzle 620 is clear, the plunger 624 returns to the position shown in FIGS. 17 and 18.

Figure 19:
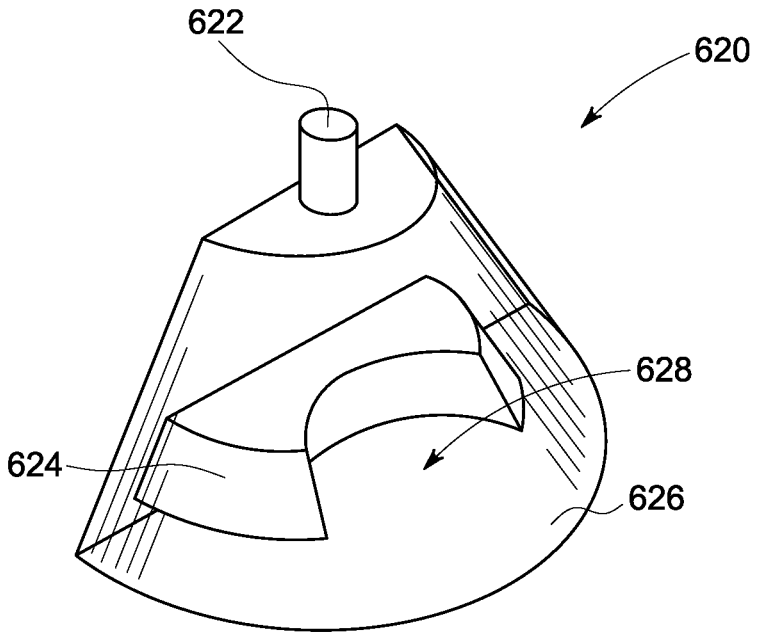
FIG. 19 is a perspective view of the anti-clogging nozzle of FIG. 17, in accordance with an embodiment of the invention, in a clogged state.
Figure 20:
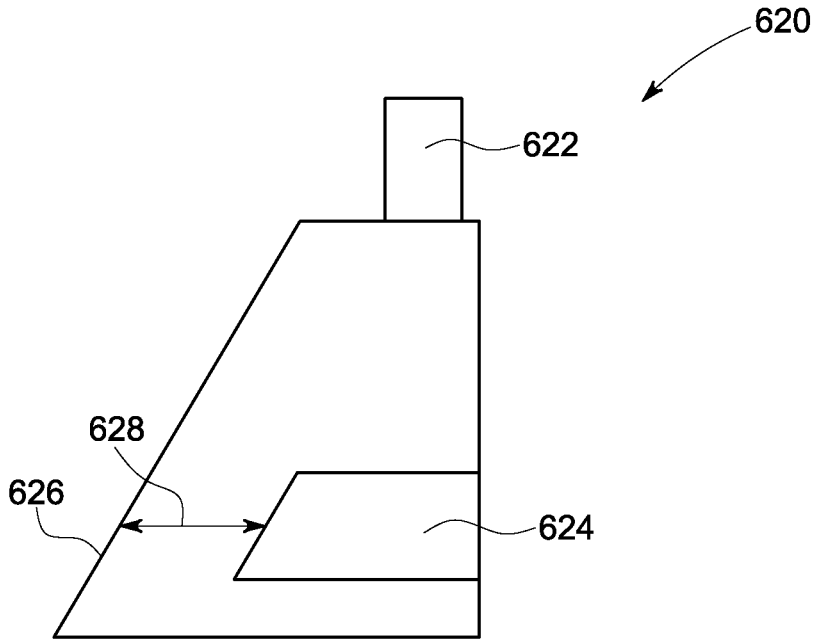
FIG. 20 is a partial, side cross-sectional view of the anti-clogging nozzle of FIG. 19.
Figure 21:
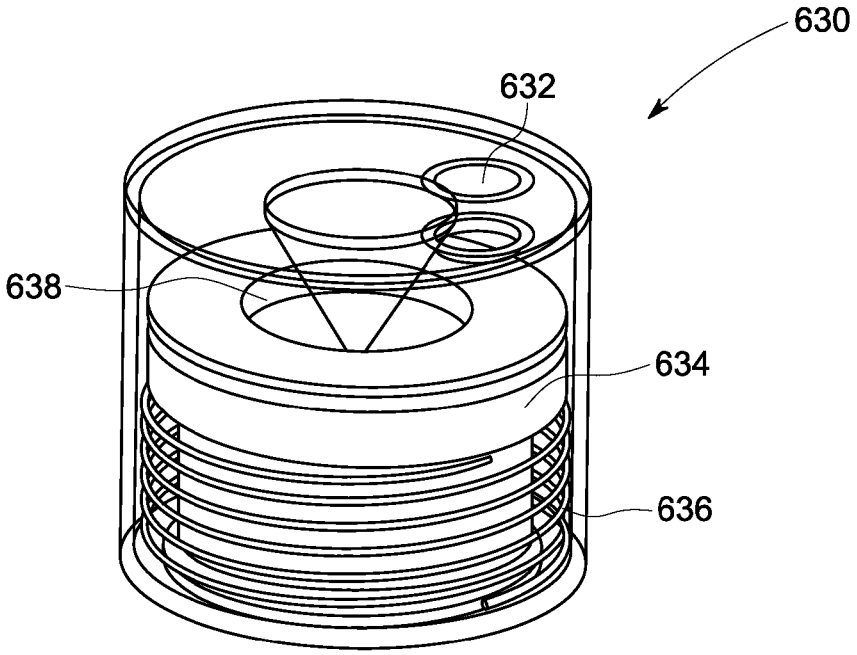
FIG. 21 is a perspective view of an anti-clogging nozzle, in accordance with an embodiment of the invention, in an un-clogged state, for use with a tractive effort system.
Figure 22:
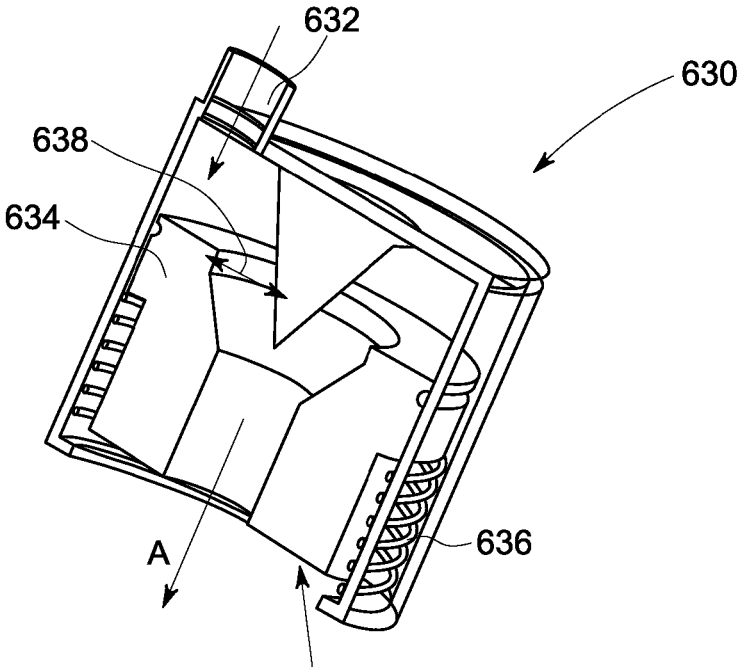
FIG. 22 is a partial, side cross-sectional view of the anti-clogging nozzle of FIG. 21.
Figure 23:
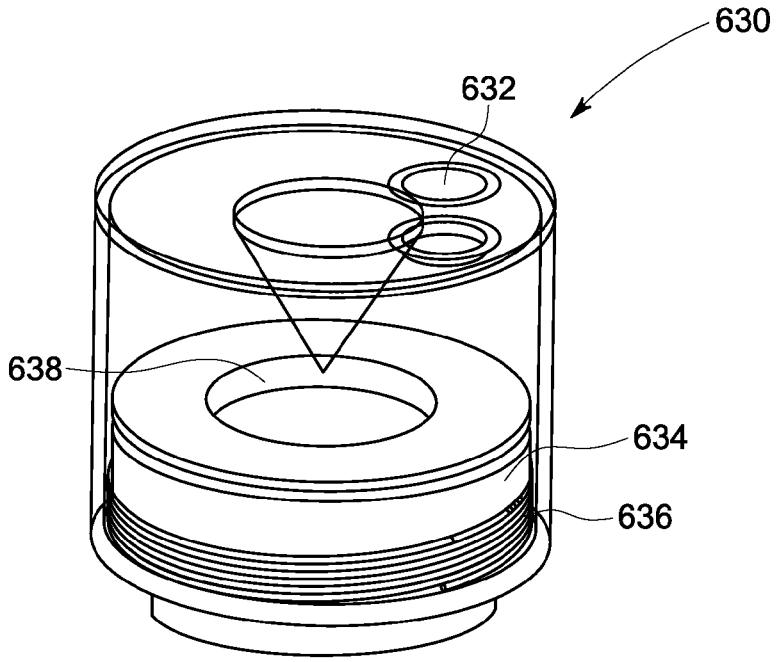
FIG. 23 is a perspective view of an anti-clogging nozzle of FIG. 21, in accordance with an embodiment of the invention, in a clogged state.
Figure 24:
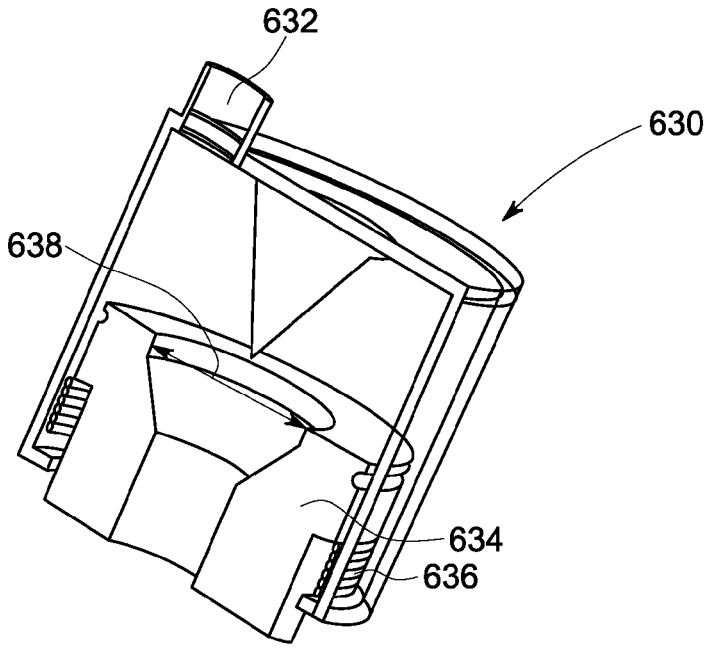
FIG. 24 is a partial, side cross-sectional view of the anti-clogging nozzle of FIG. 23.

Referring to FIGS. 21-24, another embodiment of an anti-clogging nozzle 630 is shown. As shown therein, tractive material is supplied to the nozzle outlet by a passageway 632. The nozzle includes a plunger 634 that moves up and down by means of a spring 636, as the internal/upstream pressure within the nozzle 630 is varied. FIGS. 21 and 22 illustrates the plunger 634 and spring 636 position under normal operating conditions, i.e., when the nozzle 630 is not clogged. As shown therein, tractive material moves past the plunger 604 through passage 638 and is ejected from the nozzle 600. When abrasive particles agglomerate, however, as discussed above, flow of tractive material out of the nozzle is hindered and pressure builds upstream of the plunger 634. As pressure builds, the plunger 634 is forced downwards in the direction of arrow A, compressing the spring 636, as shown in FIGS. 23 and 24. As the plunger 634 is moved downwards, the area of the passage 638 is increased, thus allowing bigger abrasive particles to clear the orifice and the nozzle 630. After the larger abrasive particles have been dispensed out of the nozzle 630 and the nozzle 630 is clear, the spring 636 biases the plunger 634 to its default position, as shown in FIGS. 18 and 19, decreasing the area of the passage 638.

Anti-clogging nozzles, 600, 610, 620 and 630 may be self-actuatable in response to pressures within the nozzle. In an embodiment, the nozzles also may include a pneumatic actuator or electro-magnetic actuator to move the plunger in response to a signal from the controller. In an embodiment, the signal may be based on one or more of an elapsing time period, clog detection, or the measured slippage of the wheels (directly or indirectly).

The nozzle itself may be formed of a material sufficiently hard to resist appreciable wear from contact with and the high-speed flow of the tractive material. As disclosed above, in an embodiment, a wear resistant inner liner 508 may be utilized to resist wear from contact with the tractive material. In other embodiments, the entire nozzle may be cast from wear-resistant material. As discussed above, suitable wear-resistant materials include high strength metal alloys and/or ceramics.

In an embodiment, the nozzle may be one of a plurality of nozzles or the nozzle may define a plurality of apertures. Each aperture or nozzle may have a different angle of incidence relative to the contact surface. A manifold may be included, which may be controlled by the controller to selectively choose the angle of incidence. The controller may determine the angle of incidence to innate or maintain based at least in part on feedback signals from one or more electronic sensors. These sensors may measure one or more of the actual and direct angle of incidence, or may provide information that is used to calculate the angle of incidence. Such calculated angles may be based on, for example, the wheel diameter or a mileage of the corresponding wheel. If the mileage of the corresponding wheel is used then the controller may consult a wear table that models wheel wear over a determined amount of wheel usage. This may be a direct mileage measurement, or may itself be calculated or estimated. Methods for estimated mileage include a simple duration of use multiplied by the average speed, or by GPS location tracking. As the wheels are not replaced at the same intervals, individual wheels and wheel sets may be tracked individually to make these calculations. The controller instruction sets may use more than one indirect calculation to conservatively allow for such alignment and adjustments.

Referring back to the nozzle disclosed generally in FIG. 2, in an embodiment, the nozzle may be supported by a housing that is coupled to truck frame or to an axle housing structure. In one embodiment, the nozzle may be oriented to direct the tractive material away from the wheel, and particularly so that the tractive material is substantially not present when the wheel contacts the contact surface. Such an orientation may be off to a side from the travel direction and angled towards the contact surface. The angle may be inward toward the center between two rails, or may be pointed wayside outwards from the track center. In an embodiment, the orientation of the nozzle may be front facing into the direction of travel and away from the wheel.

Rail wheels may have a single flange that rides on the inward side of a pair of rails. Thus, a stream traveling from inside the rails outward would first encounter or pass the flange before encountering the rail surface. In one embodiment, the aim of the nozzle may be directed around the flange portion of a flanged wheel. And, a nozzle pointing inward would emit a stream that would contact the rail surface prior to contacting the flange. The location and orientation of the nozzle, then, may be characterized in view of the flange location of the wheel. In one embodiment, an outward facing nozzle is directed to a rail contact surface in advance of the wheel/rail interface such that the flange is not an obstruction. In another embodiment, an inward facing nozzle is directed relatively more near the rail/wheel interface or at the rail/wheel interface (compared to an outward facing nozzle) owing to a pathway to the rail surface that is unobstructed by the flange.

In one embodiment, the nozzle is disposed above and horizontally outside the plurality of rails, and is oriented relative to the rail inward facing towards the plurality of rails. The nozzle may be oriented such that the flow is directed at the contact surface at a contact angle (angle of incidence) that is in a range of from about 75 degrees to about 85 degrees relative to a horizontal plane defined by the contact surface. The nozzle may be oriented further such that the flow is directed at the contact surface at a contact angle that is in a range of from about 15 degrees to about 20 degrees relative to a vertical plane defined by a direction of travel of the wheel. The contact angle can be measured such that the flow of tractive material is from the outside pointing inward towards the plurality of rails.

Figure 25:
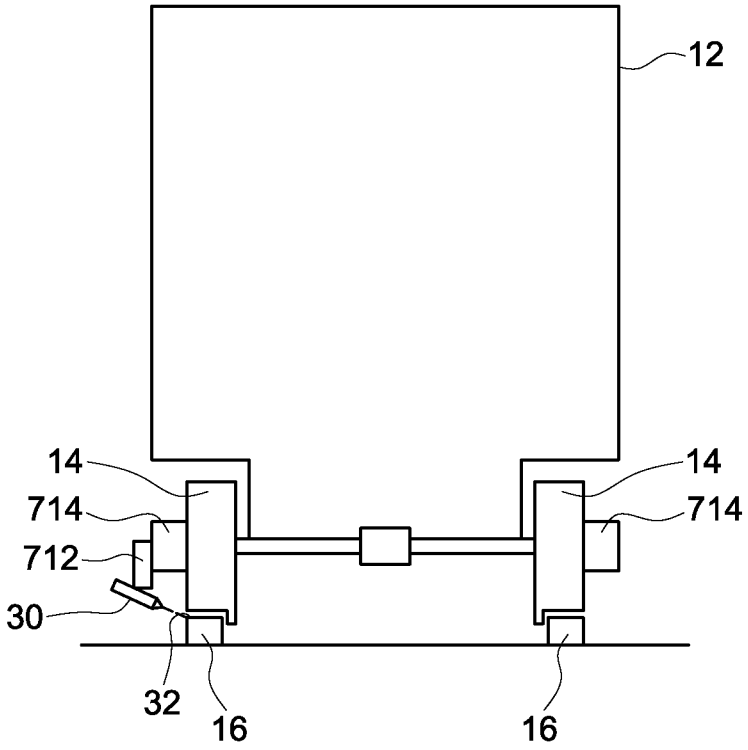
FIG. 25 is a schematic drawing of a portion of a tractive effort system illustrating the position of a nozzle on a journal box of a vehicle, as viewed from the front of a vehicle, in accordance with an embodiment of the invention.

As shown in FIG. 25, in an embodiment, the nozzle 30 and nozzle alignment device may be mounted to and supported by a journal box 714 that is coupled to a powered axle of the vehicle 12. The nozzle may be supported from the journal box that is both one of a plurality of journal boxes and is the first journal box in the direction of travel of the vehicle 12. In an embodiment where the vehicle 12 is capable of moving forwards and backwards, the nozzle is supported from the journal box that is first or last, depending on whether the vehicle is traveling, respectively, forwards or backwards. In an embodiment, the nozzle may be supported from a journal box that is a subsequent journal box after the first journal box in the direction of travel of the vehicle that does not translate during a navigation of a curve by the vehicle. As discussed above and as further shown in FIG. 26, in an embodiment, the nozzle 30 is disposed above and laterally outside the rails 16 and is oriented relative to the rail inward facing from the rails 16.

The distance and the orientation of the nozzle from the desired point of impact may affect efficiency of the system. In one embodiment, the nozzle is less than a foot away from the contact surface. In various embodiments, the nozzle distance may be less than four inches, in a range of from about 4 inches to about 6 inches, from about 6 inches to about 9 inches, from about 9 inches to about 12 inches, or greater than about 12 inches from the contact surface. As disclosed above with regard to the flange arrangement, the flange location precludes some shorter distances from certain angles and orientations. Where the nozzle is configured to point from the inside of the rails outward, as the contact surface approaches the wheel/rail interface the distance must necessarily increase to account for the flange. Thus, systems used to blow snow, for example, away from the rails to prevent accumulation or build up between the rails have different constraints on location and orientation than a system with inward facing nozzles.

In an embodiment, the nozzle (or nozzles in embodiments where multiple nozzles are utilized) may respond to vehicle travel conditions or to location information (e.g., global positioning satellite (GPS) data) to maintain a determined orientation relative to the contact surface while the vehicle travels around a curve, upgrade, or down grade, as discussed in detail below, in response to a signal, the nozzle may displace laterally, displace up or down, or the nozzle distribution pattern of the tractive material may be controlled and/or changed. In an embodiment, the change to the pattern may be to change from a stream to a relatively wider cone, or from a cone to an elongate spray pattern. The nozzle displacement and/or distribution pattern may be based on a closed, loop feedback based on measured adhesion or slippage. Further, the nozzle displacement may have a seeking mode that displaces and/or adjusts the dispersal pattern, and/or the flow rate or tractive material speed or pressure in the reservoir tank to determine a desired traction level or levels for any adjustable feature.

In an embodiment, in order to improve wheel-rail adhesion during braking and acceleration, tractive material may be dispensed from the nozzle(s) 30 and delivered at the wheel-rail interface, i.e., the area where the wheel contacts the rail. In addition, when the locomotive 12 is running on a straight track, tractive material is delivered between the wheel-rail interface to improve the adhesion. As the locomotive 12 traverses a curve, however, the end axles of the locomotive 12 move laterally and change the location of the wheel-rail interface, thereby reducing effectiveness of a system employing a fixed position nozzle.

In order to achieve a determined adhesion level, the nozzle angle with respect to the contact surface may be corrected continuously and in real-time in an embodiment. Operational input, including data about whether the vehicle is traveling on either straight or curved, tracks, may be sensed continuously during travel to precisely deliver tractive material to the contact surface through the nozzle or the wheel/rail interface through the sand dispenser. As used herein, operational input can include input motion, model predictions, map or table based input that is based on vehicle location data, and the like. Input motion means linear motion between the axle or axle mounted components and the truck frame, and angular motion between the truck and car body.

In one embodiment, a system is provided for use with a wheeled vehicle that travels on a surface. The system includes the nozzle, and an air source for providing tractive material at a flow rate that is greater than 100 cubic feet per minute (2.83 cubic meters per minute) as measured as the tractive material exits the nozzle, and the air source is in fluid communication with the nozzle that receives the tractive material from the air source and directs a flow of the tractive material to a location on the surface that is a contact surface. The air source is a main reservoir equalization (MRE) tank or pipe of a locomotive, and the determined parameter is unregulated and is the same pressure as a pressure in the main reservoir equalization tank or pipe during operation of the vehicle.

A controller can respond to a signal based on operation of a compressor fluidly coupled to the MRE or to the sensed pressure in the main reservoir equalization tank or pipe and controls a valve that is capable of controlling or blocking the flow of tractive material from the air source to the nozzle. The controller is further capable of controlling operation of the compressor, and responds to operation of the compressor such that on/off cycling of the compressor above a threshold on/off cycling level by one or both of operating the compressor to reduce the on/off cycling or operating the valve to change the flow rate of the tractive material through the nozzle. The controller can respond to a sensed drop in the pressure in the main reservoir equalization tank or pipe that is below a threshold pressure level by reducing or blocking the flow of tractive material, and thereby to maintain the MRE pressure above the threshold pressure level.

During use, the media holding reservoir, if such is fluidly coupled to the nozzle, can provide particulate tractive material to fluidly combined or entrained in the flow of tractive material (air) that impacts the contact surface.

The system may include an adjustable mounting bracket for supporting the nozzle. A suitable adjustable mounting bracket may include bolts that secure the nozzle in a determined orientation when tightened, and that allow for repositioning of the nozzle and calibration of the nozzle aim when loosened. Manual adjustment and calibration can be performed periodically or in response to certain signals. The signals can include a change in the season or weather (as some orientations may work differently depending on whether the debris is water, snow or leaves) or a change in the vehicle condition (such as wheel wear or wheel replacement). Automatic or mechanical alignments are contemplated in connection with a system that provides feedback information for auto-alignment or alignment based on environmental or operational factors (such as navigating a curve).

Figure 26:
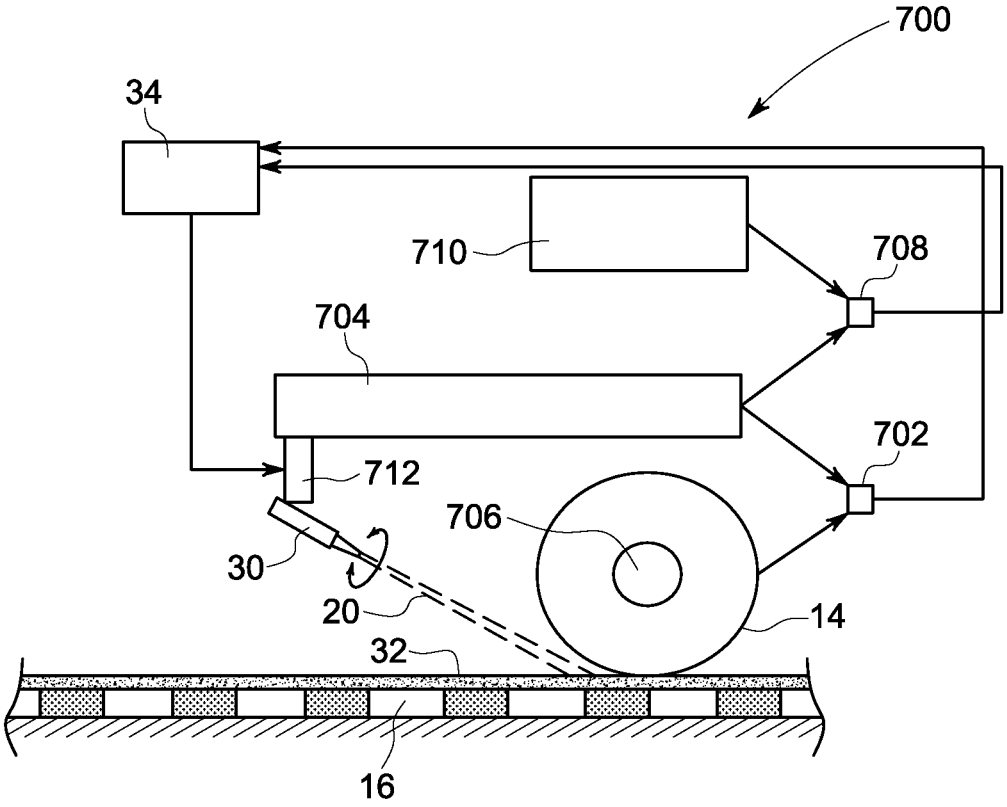
FIG. 26 is a schematic drawing of an automatic nozzle directional alignment system in accordance with an embodiment of the invention, for use with a tractive effort system.

A schematic illustration of a system 700 for nozzle directional alignment for use with the tractive effort systems disclosed above is shown in FIG. 26. In the illustrated embodiment, input motion is sensed continuously by one or more sensors operatively connected to the locomotive. In particular, a sensor 702 may continuously sense the linear motion between the truck 704 and the axle/axle mounted components 706. A sensor 708 may also continuously sense the angular motion between the truck 704 and the car body 710.

Suitable sensors may be mechanical, electrical, optical or magnetic sensors. In an embodiment, more than one type of sensor may be utilized. The sensors 702, 708, may be electrically coupled to the controller and may relay signals indicating truck versus axle motion and truck/carbody motion to the controller for conditioning. Optionally, there may be no signal conditioning. The controller sends a signal to a nozzle alignment device 712, which is operatively connected to the nozzle, to modify the orientation/angle of the nozzle instantaneously to ensure that tractive material is constantly delivered, towards the wheel-rail interface, thereby improving the adhesion of the locomotive, especially around curves.

The nozzle alignment device may be operated mechanically, electrically, magnetically, pneumatically or hydraulically, or a combination thereof to adjust the angle of the nozzle with respect to the contact surface of the rail. In an embodiment, the nozzle directional alignment system also may be used to control the alignment of the sand dispenser, in the same manner as described above.

The controller may receive signals from sensors, as discussed above, or from a manual input, and may control various features and operations of the tractive effort system. For example, the controller may control one or more of the on/off state of the system, a flow rate of the tractive material, or the speed of the tractive material through the nozzle. Such control may be based on one or more of the speed of the vehicle relative to the track, the amount of debris on the track, the type of debris on the track, a controlled loop feedback of the amount or type of debris on the track actually being removed by the tractive material, the type of track, the condition of the contact surface of the track, a controlled loop feedback based at least in part on detected slippage of the wheel on the track, and the geographic location of a vehicle comprising the wheel such that the tractive material is directed or not directed to the contact surface in certain locations. That is, the controller can deploy the tractive material in response to an external signal that includes one or both of travel conditions or location information.

With further reference to the operation of the controller, in an embodiment, it may receive sensor input that detects a pressure level in the reservoir tank or pressure vessel, and may control the deployment of the tractive material only when the pressure level is in a determined pressure range. In an embodiment, the controller may control the pressure level in the reservoir or the pressure vessel 202 by activating an air compressor. The deployment of the tractive material, by the controller, can be continuous or pulsed/periodic. The pulse duration and frequency may be set based on determined threshold levels. These levels may be the measured or estimated amount of tractive material available, the time until the tractive material can be replenished, the season of the year and/or geography (which may indirectly indicate the type and quantity of leaves or snow), and the like. In one embodiment, the controller can cease deployment of the tractive material in response to a direct or indirect adhesion level being outside of determined threshold values. Outside the threshold values includes an adhesion that is too low, naturally, but also if too high or at least sufficient so as to conserve the tractive material reserve. And, if the adhesion level is too low even after deployment of the tractive material, and if the seeking mode is not present or is not successful, and if there is no indication of a clog, then the controller may conserve the tractive material merely because there is no desired improvement.

In one embodiment, the controller can deploy, or suspend deployment, of the tractive material based on location or the presence of a particular feature or structure. For example, in the presence of a wayside lubricator station the controller may suspend deployment. In other embodiments, it may be set to only deploy tractive material when on a curve or grade. Location may be provided by GPS data, as discussed above, by a route map, or by a signal from the structure or features (e.g., an RFID signature). For example, a rail yard may have a defined zone, communicated to the controller, in which the controller will not actuate the tractive effort system.

An embodiment of the invention relates to a tractive effort system for modifying the traction of a wheel contacting a rail. The tractive effort system may include a media reservoir capable of holding an tractive material, a nozzle in fluid communication with the media reservoir, and a media valve in fluid communication with the media reservoir and the nozzle, the media valve being controllable between a first state in which the tractive material flows through the media valve and to the nozzle, and a second state in which the tractive material is prevented from flowing to the nozzle. In the first state the nozzle receives the tractive material from the media reservoir and directs the tractive material to a contact surface of the rail such that the tractive material impacts the contact surface prior to the wheel contacting the contact surface and modifies the traction of the wheel contacting the rail. The tractive effort system may further include an air reservoir capable of holding a volume of pressurized air, the air reservoir being in fluid communication with the nozzle, and an air valve in fluid communication with the air reservoir and the nozzle, the valve being controllable between a first state in which the pressurized air flows through the air valve and to the nozzle, and a second state in which the pressurized air is prevented from flowing to the nozzle. The system may include a controller electrically coupled to the media valve and the air valve for controlling the media valve and the air valve between the first states and the second states, respectively.

A sand dispenser may be included that is oriented to deposit a layer of sand at the wheel/rail interface. The tractive effort system may include a pressure vessel in fluid communication with an output of the media reservoir, an output of the air reservoir and an input of the media valve, a batch valve positioned between the media reservoir and the pressure vessel and being controllable between a first state in which the tractive material flows through the batch valve and to the pressure vessel, and a second state in which the tractive material is prevented from flowing to the pressure vessel, and a second air valve positioned between the air reservoir and the pressure vessel, the second air valve being controllable between a first state in which pressurized air flows through the second air valve and to the pressure vessel, and a second state in which the pressurized air is prevented from flowing to the pressure vessel.

The air reservoir may be in fluid communication with the media reservoir. In such an embodiment, the system may include a pressurizing air valve positioned between the air reservoir and the media reservoir and being controllable between a first state in which the pressurized air flows through the pressurizing air valve and to the media reservoir for pressurizing the media reservoir, and a second state in which the pressurized air is prevented from flowing to the media reservoir.

In one embodiment, the tractive material impacts the contact surface and removes debris from the contact surface. In addition or alternatively, when the tractive material impacts the contact surface the morphology of the contact surface may be changed from smooth to rough. Where the morphology of the contact surface is changed, the modified roughness may be greater than about 0.1 micrometer and less than 10 millimeter of the profile roughness parameter, e.g. the modified morphology may have peaks with a height that is greater than about 0.1 micrometer and less than 10 millimeters. Tractive effort may increase by at least 40,000 during application of the tractive material, e.g., tractive effort increases by a tractive effort value of more than 40,000 during application of the tractive material. In embodiments, the system may be mounted on a vehicle and the wheel may be coupled to a power axle of the same vehicle. In other embodiments, the system may be mounted on a vehicle that is part of a consist comprising a plurality of linked vehicles, wherein the wheel may be coupled to a different vehicle in the consist. The tractive material may be one or more of silica, alumina and iron oxide. The tractive material may be an organic material. The tractive material may be include nut, crustacean or sea shells.

The nozzle may include first and second halves that cooperate to define a restriction during an operating mode and may be separable from each other during a cleaning mode. A push ram mechanism may be deployed through an orifice defined by the nozzle to unclog the nozzle, and the push ram may include a pneumatic or electro-magnetic actuator coupled to the push ram that is actionable in response to a signal from the controller. The nozzle may be oriented to direct the tractive material away from the wheel. At least a portion of the nozzle may be formed from a material sufficiently hard to resist appreciable wear from contact with the high-speed flow of tractive material. The controller may deploy the tractive material in dependence upon vehicle travel conditions or location information. In addition, the media reservoir may be coupled to a heater, a vibrating device, a screen or filter and/or a de-watering device.

Another embodiment of the invention relates to a tractive effort system for modifying the traction of a wheel of a vehicle contacting a rail. The tractive effort system may include a media reservoir capable of holding an tractive material, a nozzle in fluid communication with the media reservoir and capable of receiving the tractive material from the media reservoir and directing the tractive material to a contact surface of the rail, a sensor configured to detect input motion, and a controller in electrical communication with the sensor for receiving input motion data therefrom. The controller may adjust the orientation of the nozzle in dependence upon the detected input motion. The input motion may be linear motion between an axle of the vehicle and a truck frame of a vehicle or the angular motion between a truck and a carbody of the vehicle. The sensor may be one of a mechanical, electrical, optical and magnetic sensor. A plurality of sensors for sensing input motion may also be used.

Yet another embodiment relates to a nozzle for use with the tractive effort system for increasing rail adhesion for a vehicle having a wheel contacting the rail. The nozzle includes a body defining a passageway there through and having an inlet accepting an tractive material and an outlet distributing the tractive material to a contact surface of the rail, and an adjustment mechanism positioned within the passageway and movable between a first position and a second position for adjusting a flow area of the passageway. The adjustment mechanism may include a plunger slidably received in the passageway and a spring operatively connected to the plunger such that the spring biases the plunger away from the outlet and into the passageway. When pressure builds up within the nozzle body, the plunger is urged against the bias of the spring and out of the passageway to increase the flow area of the passageway. The body and passageway may be generally cone-shaped and the adjustment mechanism may include a complimentary-shaped plunger slidably received by the passageway and having a relief portion for permitting flow of the tractive material past the plunger. The plunger may be movable between the first position in which a periphery of the plunger is closely received by a wall of the passageway and a second position in which a periphery of the plunger is spaced a distance from the wall of the passageway. An actuator may be included to moving the plunger from the first position and the second position in response to signal from a controller. The signal may be based on one or more of elapsing time period, clog detection and measured slippage of the wheel on the rail. Moreover, the adjustment mechanism may include a plunger slidably and closely received by the passageway and having a conical recess formed therein in fluid communication with the inlet and the outlet, and the body having a conical projection projecting towards the conical recess. A spring may operatively engage the plunger to bias the plunger towards the conical projection such that the conical projection is at least partly received by the conical recess. When pressure builds up within the nozzle body, the plunger may be urged against the bias of the spring and away from the conical projection to increase the flow area through the conical recess.

Another embodiment relates to a controller and a method of increasing rail adhesion for a vehicle having a wheel contacting a rail of a track. A flow of tractive material may be controlled from a media reservoir to a nozzle. A flow of pressurized air is controlled from an air reservoir to the nozzle. A contact surface of the rail ahead of the wheel may be impacted with the tractive material to remove debris or to modify the surface roughness of the rail. An orientation of the nozzle may be adjusted depending upon vehicle travel conditions or location information to maintain a determined orientation relative to the contact surface. The vehicle travel conditions may include one or more of the wheel encountering a curve, the vehicle traveling up grade and the vehicle traveling down grade. The nozzle may be displaced laterally and/or up or down in response to the vehicle travel conditions or location information.

A flow rate or speed of the tractive material may be controlled through the nozzle in response to at least one of a speed of the vehicle relative to the rail, an amount of debris on the rail, a type of debris on the rail, a controlled loop feedback of the amount or type of debris on the rail actually being removed by the tractive material, a type of rail, a condition of the contact surface of the rail, sensed vibrations indicative of the contact surface, a controlled loop feedback based at least in part on detected slippage of the wheel on the rail or measured adhesion, and a geographic location of the vehicle comprising the wheel. A pressure level in the air supply or in the media reservoir (if such is used) can be detected and/or monitored and depending on the pressure, the tractive material can be deployed when the pressure level is in a determined pressure range.

A pressure level in the media reservoir may be increased by activating an air compressor in fluid communication with the media reservoir. The method may include controlling a media valve to a closed position to stem the flow of tractive material to the nozzle and impacting the contact surface of the rail with the pressurized air. The method may include dispensing a layer of sand from the media reservoir on the rail through a sand dispenser. Deployment of the tractive material may be controlled in dependence upon the vehicle's navigation of a curve or grade of the track. Further, the deployment of the tractive material may be in dependence upon the vehicle location relative to one or more of a crossing, a residential neighborhood, or a designated zone based on sensitivity to noise, dust or propelled objects caused by the flow of pressurized air. Suitable methods for determining the vehicles location, such as on approach to a crossing, can include stored map data, calculated distance traveled on a known route, global positioning satellite (GPS) data, wayside equipment signals, and the like. Designated zones may include safety areas, and may be dynamic. For instance, if a rail yard employee were to carry a signaling device that has a radius (x), then any system that could sense the signaling device would determine that the employee was within radius (x) and could therefore be subject to debris thrown by high velocity traction material should the tractive effort system be operating. Moreover, the method may include cleaning the nozzle if or when the nozzle becomes clogged. The cleaning can be done periodically or in response to some sensed parameter, such as tractive effort or the like.

Because a vehicle operator may not be aware of the tractive effort available, one embodiment includes a signaling mechanism that alerts the operator when the system is engaging in an attempt to increase the traction. That is, when slippage is detected or if system engagement is warranted there is also a signal for the operator to know that conditions exist calling for more traction. This information may allow for indication that a nozzle or nozzles are not aligned or are clogged, that a tractive media reservoir is empty, or that some condition exists that needs attention. Further, information about slippage and/or the need for increase traction may be collected and reported to a database or equivalent for use in generating a map of a network that indicates network conditions. Further, this collected information can be fed into a network management program to better allocate asset movement and scheduling through the network based at least in part on a traction model using the reported slippage data. The data may be collected at an arrival/departure destination or may be collected in closer to real time using wireless data and uploading to a remote site.

A rail network controller may be used with a rail network that has arrival/departure locations connected via railway tracks, and through which a plurality of locomotives may travel on the tracks from one location to another location. The rail network controller tracks which of the locomotives has a tractive effort management system and also tracks which of the arrival/departure locations has a reduced traction situation based on information provided to the network controller by the tractive effort management system. The rail network controller responds to the reduced traction situation by one or both of controlling a velocity of the locomotives through the rail network such that the starting or stopping distance or time of a locomotive at a location having a reduced traction situation is calculated differently by the rail network controller if the locomotive includes a tractive effort management system relative to a locomotive that does not have a tractive effort management system, or controlling a routing of the plurality of the locomotives through the rail network based on both of the presence or absence of a tractive effort management system on a locomotive and the reduced traction situation at one or more of the arrival/departure locations.

In one embodiment, the tractive effort system is provided for use with a locomotive having a wheel that travels on a rail. The system includes a nozzle oriented away from the wheel, and configured for delivering sand and/or air under pressure to a contact surface of the rail that is spaced from a wheel/rail interface. Optionally, a regulator may be coupled to the locomotive supply of compressed air. The regulator reduces the pressure of the air supplied to the nozzle to be less than an air pressure in a brake line of the locomotive. A second nozzle and an air supply pipe may be coupled to each nozzle and to the regulator, wherein the air supply pipe includes a "T" joint. A single magnetic valve or solenoid can controls a flow of pressurized air through the air supply line and to each nozzle. Alternatively, individual nozzle control can be obtained by using valves associated with each nozzle. The system may further include one or more of an on/off or able/disable switch that, in the "able" or "on" mode allows the system to operate or a functional device that selectively prevents the system from delivering the air and/or sand. And, shaft-driven compressors can the supply the compressed air. A shaft-driven compressor can be mechanically coupled to an engine for providing torque to the compressor through a shaft when the engine is operating. Alternatively, a motor driven compressor can be used.

In one embodiment, a control system is provided for use with a vehicle. The control system includes a controller that can control a valve that is fluidly coupled to a nozzle. Tractive material may selectively flow through the nozzle to a contact surface that is proximate to but spaced from an interface of a wheel and a surface. The valve can open and close in response to signals from the controller. The controller can control the valve to provide tractive material to the contact surface or can prevent the flow of tractive material to the contact surface. The provision of tractive material may be in response to one or more trigger events, in which instance the controller will cause the valve to open and to provide tractive material to the nozzle. The trigger events include one or more of adhesion limited operation of the vehicle, loss or reduction of tractive effort during operation of the vehicle, and an initiation of a manual command calling for the provision of the tractive material. The prevention of the flow of tractive material may be in response to one or more prevention events. The prevention events may include the vehicle entering or being within in a designated prevention zone, an engagement of a safety lock out for the vehicle, a sensed measurement of available pressure in an airbrake system of the vehicle being below a threshold pressure level, a sensed measurement of a compressor on/off cycling pattern being within a determine set of cycling patterns, and a speed or a speed setting of the vehicle being in a determined speed range or determined speed setting range, respectively.

In one embodiment, a kit is provided for upgrading a vehicle having a wheel that travels on a rail, where a portion of the rail is a contact surface that is spaced from a wheel/rail interface. The kit may include an optional media reservoir capable of holding a particulate type of tractive material; an air source for providing air-based tractive material and that is capable of having one or more of a pressure that is greater than 100 psi (about 689500 Pascal) as measured prior to the tractive material exiting the nozzle, at a flow rate that is greater than 100 cubic feet per minute (2.83 cubic meters per minute) as measured as the tractive material exits the nozzle, or at a velocity of greater than 150 feet per second (greater than 45 meters per second) as measured as the tractive material impacts the contact surface; and a nozzle that is in fluid communication with the air source that is capable of receiving and directing the air-based tractive material to the contact surface. The nozzle optionally may have a body defining a passageway therethrough and having an inlet accepting an tractive material and an outlet distributing the tractive material to the contact surface and an adjustment mechanism positioned within the passageway and movable between a first position and a second position for adjusting a flow area of the passageway, and optionally the nozzle may be disposed above and horizontally between a plurality of rails. This would be oriented relative to the rail outward facing from the plurality of rails.

The kit can include a controller in electrical communication with a sensor operable to detect operational data. The controller can change an angle of incidence of the tractive material relative to the contact surface depending on the operational data.

In one embodiment, a vehicle includes a first powered axle and a second powered axle. The first powered axle is proximate an end of the vehicle, and the second powered axles is relatively distant from the vehicle end, and the second powered axle is coupled to a journal box that does not translate during a navigation of a curve by the vehicle. A tractive effort management system is coupled to the journal box of the second powered axle. Optionally, the vehicle may include a first operator cab and a second operator cab, and each operator cab is at respective distal ends of the vehicle. Mounting the tractive effort management system to the second powered axle may allow the vehicle to be driven forward or backward as desired, or put into service forwards or backwards, while maintaining a substantially constant level of tractive effort performance. Naturally, having the tractive effort management system providing tracks with relatively increased tractive ability for all of the powered wheels may be desirable in some instances, but this might require nozzles located at both ends of the vehicle (as contemplated in other embodiments) increasing the system cost and complexity. Thus, a 'directionally' indifferent locomotive model may be used by locating the nozzles off of the lead powered axles. This would provide flexibility in vehicle usage and potentially reduce the management oversight needed during a train build in a rail yard. Further, because the second powered axle does not "steer" around curves the nozzle alignment (so that the flow of tractive material hits the contact surface) can approach one hundred percent on target performance.

The above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects, unless otherwise stated.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system for use with a vehicle, comprising:

a media reservoir capable of holding a tractive material that includes particulates;

a nozzle in fluid communication with the media reservoir; and a media valve in fluid communication with the media reservoir and the nozzle, the media valve being controllable between a first state in which the tractive material flows through the media valve and to the nozzle, and a second state in which the tractive material is prevented from flowing to the nozzle, and in the first state the nozzle receives the tractive material from the media reservoir and directs the tractive material to a contact surface such that the tractive material impacts the contact surface that is spaced from a wheel/surface interface and to thereby modify the adhesion or the traction capability of the contact surface with regard to a subsequently contacting wheel;

wherein the system is operable to propel the tractive material so as to impact the contact surface and thereby to modify the morphology of the contact surface sufficient for an increased tractive effort of the subsequently contacting wheel relative to before the morphology of the contact surface was modified.

2. The system of claim 1, further comprising a controller that operates to control a flow rate of pressurized air, of tractive material, or both pressurized air and tractive material through the nozzle.

3. The system of claim 2, wherein the controller is configured to respond to a signal indicating a level of traction, and to change the flow rate based on the signal.

4. The system of claim 1, wherein the modified morphology has peaks with a height that is greater than about 0.1 micrometer and less than 10 millimeters.

5. The system of claim 1, wherein tractive effort increases by a tractive effort value of at least 40,000 pounds force during application of the tractive material.

6. The system of claim 1, wherein the system is mounted on a vehicle and the wheel is coupled to a powered axle of the same vehicle.

7. The system of claim 6, wherein the nozzle is supported by a first journal box.

8. The system of claim 7, wherein the first journal box is a leading journal box in the direction of travel of the wheeled vehicle, or if the vehicle is operable to move forwards and backwards then the first journal box is leading or trailing depending on whether the vehicle is traveling, respectively, forwards or backwards.

9. The system of claim 7, wherein the vehicle comprises the first journal box and a second journal box, wherein the second journal box is a leading journal box in the direction of travel of the wheeled vehicle, and wherein the first journal box is positioned subsequent the second journal box in the direction of travel of the wheeled vehicle.

10. The system of claim 9, wherein the first journal box does not translate during the navigation of a curve by the vehicle, and thus the nozzle remains more directly aimed at the contact surface during a curve than a corresponding nozzle mounted on a leading or trailing journal box that does translate during the curve navigation.

11. The system of claim 1, wherein the system is mounted on a vehicle that is part of a consist comprising a plurality of linked vehicles, and the subsequently contacting wheel is coupled to a different vehicle in the consist.

12. The system of claim 1, wherein the nozzle comprises first and second halves that cooperate to define a restriction during an operating mode, and the first and second halves are separable from each other during a cleaning mode.

13. The system of claim 1, further comprising a push ram mechanism capable of deployment through an orifice defined by the nozzle to dislodge a clog if such clog is lodged in the nozzle.

14. A system for use with a vehicle, comprising:

a media reservoir capable of holding a tractive material that includes particulates;

a nozzle in fluid communication with the media reservoir;

a media valve in fluid communication with the media reservoir and the nozzle, the media valve being controllable between a first state in which the tractive material flows through the media valve and to the nozzle, and a second state in which the tractive material is prevented from flowing to the nozzle, and in the first state the nozzle receives the tractive material from the media reservoir and directs the tractive material to a contact surface such that the tractive material impacts the contact surface that is spaced from a wheel/surface interface and to thereby modify the adhesion or the traction capability of the contact surface with regard to a subsequently contacting wheel;

an air reservoir capable of holding a volume of pressurized air, the air reservoir being in fluid communication with the nozzle;

an air valve in fluid communication with the air reservoir and the nozzle, the valve being controllable between a first state in which the pressurized air flows through the air valve and to the nozzle, and a second state in which the pressurized air is prevented from flowing to the nozzle;

a sand dispenser oriented to deposit a layer of sand directly at the wheel/rail interface;

a sand trap in fluid communication with the media reservoir, air reservoir and sand dispenser; and a sander air valve positioned between the air reservoir and the sand trap, the sander air valve being controllable between a first state in which some of the pressurized air flows through the sander air valve and to the sand trap, and a second state in which the pressurized air is prevented from flowing to the sand trap.

15. The system of claim 14, further comprising a controller electrically coupled to the media valve and the air valve for controlling the media valve and the air valve between the first states and the second states, respectively.

16. A system for use with a vehicle, comprising:

a media reservoir capable of holding a tractive material that includes particulates;

a nozzle in fluid communication with the media reservoir;

a media valve in fluid communication with the media reservoir and the nozzle, the media valve being controllable between a first state in which the tractive material flows through the media valve and to the nozzle, and a second state in which the tractive material is prevented from flowing to the nozzle, and in the first state the nozzle receives the tractive material from the media reservoir and directs the tractive material to a contact surface such that the tractive material impacts the contact surface that is spaced from a wheel/surface interface and to thereby modify the adhesion or the traction capability of the contact surface with regard to a subsequently contacting wheel;

an air reservoir capable of holding a volume of pressurized air, the air reservoir being in fluid communication with the nozzle;

an air valve in fluid communication with the air reservoir and the nozzle, the valve being controllable between a first state in which the pressurized air flows through the air valve and to the nozzle, and a second state in which the pressurized air is prevented from flowing to the nozzle;

a pressure vessel in fluid communication with an output of the media reservoir, an output of the air reservoir and an input of the media valve;

a batch valve positioned between the media reservoir and the pressure vessel, the batch valve being controllable between a first state in which the tractive material flows through the batch valve and to the pressure vessel, and a second state in which the tractive material is prevented from flowing to the pressure vessel; and a second air valve positioned between the air reservoir and the pressure vessel, the second air valve being controllable between a first state in which pressurized air flows through the second air valve and to the pressure vessel, and a second state in which the pressurized air is prevented from flowing to the pressure vessel.

17. A system for use with a vehicle, comprising:

a media reservoir capable of holding a tractive material that includes particulates;

a nozzle in fluid communication with the media reservoir; and a media valve in fluid communication with the media reservoir and the nozzle, the media valve being controllable between a first state in which the tractive material flows through the media valve and to the nozzle, and a second state in which the tractive material is prevented from flowing to the nozzle, and in the first state the nozzle receives the tractive material from the media reservoir and directs the tractive material to a contact surface such that the tractive material impacts the contact surface that is spaced from a wheel/surface interface and to thereby modify the adhesion or the traction capability of the contact surface with regard to a subsequently contacting wheel;

a push ram mechanism capable of deployment through an orifice defined by the nozzle to dislodge a clog if such clog is lodged in the nozzle; and a pneumatic or electro-magnetic actuator coupled to the push ram and being actionable in response to a signal from the controller.

* * * * *